US007937011B2

(12) United States Patent
Yamamoto et al.

(10) Patent No.: US 7,937,011 B2
(45) Date of Patent: May 3, 2011

(54) IMAGE FORMING APPARATUS AND IMAGE CONTROLLING METHOD

(75) Inventors: Yuichi Yamamoto, Abiko (JP); Eiichi Motoyama, Tokyo (JP); Yoshihito Osari, Tokyo (JP); Kuniyasu Kimura, Toride (JP); Hiroaki Tomiyasu, Toride (JP); Takahiko Yamaoka, Kashiwa (JP); Jun Tomine, Abiko (JP); Yuichi Ikeda, Abiko (JP); Yasushi Takeuchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/629,321

(22) Filed: Dec. 2, 2009

(65) Prior Publication Data

US 2010/0074645 A1 Mar. 25, 2010

Related U.S. Application Data

(62) Division of application No. 11/262,778, filed on Nov. 1, 2005, now Pat. No. 7,650,094.

(30) Foreign Application Priority Data

Nov. 12, 2004 (JP) ..... 2004-329235

(51) Int. Cl.
*G03G 15/00* (2006.01)

(52) U.S. Cl. ..... 399/71; 399/72; 399/346

(58) Field of Classification Search ..... 399/71, 399/72, 346
See application file for complete search history.

(56) References Cited

U.S. PATENT DOCUMENTS

| | | | |
|---|---|---|---|
| 5,073,800 | A | 12/1991 | Yamaguchi et al. |
| 5,657,114 | A | 8/1997 | Kitajima et al. |
| 5,740,495 | A | 4/1998 | Maher et al. |
| 6,233,413 | B1 | 5/2001 | Folkins |
| 6,985,679 | B2 | 1/2006 | Koh et al. |
| 2005/0202177 | A1 | 9/2005 | Ikeda |

FOREIGN PATENT DOCUMENTS

| | | | |
|---|---|---|---|
| JP | 57-74754 | A | 5/1982 |
| JP | 58-172655 | A | 10/1983 |
| JP | 2000-231274 | A | 8/2000 |

(Continued)

OTHER PUBLICATIONS

Partial English-language translation of Office Action dated Dec. 14, 2007, issued in Chinese Patent Application No. 2005-10119410.9.

(Continued)

*Primary Examiner* — David P Porta
*Assistant Examiner* — Bryan P Ready
(74) *Attorney, Agent, or Firm* — Fitzpatrick, Cella, Harper & Scinto

(57) ABSTRACT

An image forming apparatus includes an image bearing member; toner image formation means for forming a toner image on the image bearing member; removing means for removing deposited matter deposited on the image bearing member; detecting means for detecting a toner image to be detected, formed on the toner image formation means; control means for controlling a toner image forming condition of the toner image forming means in accordance with a result of detection of the toner image to be detected by the detecting means; the apparatus being operable in a mode in which the removing means operates to remove the deposition, and the detecting means operates to detect the toner image to be detected, executing means for executing an operation in the mode; and an operating portion for manually starting execution of the operation in the mode by the executing means.

5 Claims, 21 Drawing Sheets

FOREIGN PATENT DOCUMENTS

| | | | |
|---|---|---|---|
| JP | 2001-134109 | A | 5/2001 |
| JP | 2004-29592 | A | 1/2004 |

OTHER PUBLICATIONS

Machine translation of JP 2001-134109.

European Search Report dated Feb. 16, 2006, issued in European Patent Application No. 05024105.8-2209.

Communication pursuant to Article 94(3) EPC, dated Mar. 19, 2010, in European Application No. 05 024 105.8-2209.

IMAGE FORMING APPARATUS AND IMAGE CONTROLLING METHOD

This application is a divisional of U.S. patent application Ser. No. 11/262,778, filed Nov. 1, 2005.

FIELD OF THE INVENTION AND RELATED ART

The present invention relates to an image forming apparatus employing an intermediary transferring member. In particular, it relates to an image forming apparatus, and the operating method therefor, which enable the operator of the image forming apparatus to manually cause the image forming apparatus to operate in the mode for eliminating the cause(s) of the image defect(s), as the operator notices the presence of an image defect (defects) in an image formed by the image forming apparatus.

As for the modes in which an image forming apparatus can be operated to eliminate a cause (or causes) of an image defect (image defects), there is an automatic mode which is automatically carried out based on the cumulative number of the prints yielded by an image forming apparatus, or the like factors, and a manual mode which is carried out as the switch for starting the manual mode is pressed by the operator of the image forming apparatus.

An image forming apparatus, which can be manually instructed by its operator to operate in the mode for eliminating the cause (causes) of the formation of a defective image, makes it possible for the operator to deal with a situation in which the image forming apparatus has yielded an image suffering from an unexpected image defect.

Japanese Laid-open Patent Application 2001-134109 discloses an image forming apparatus which can be controlled by its operator through its control panel to operate in a cleaning mode for clearing the intermediary transferring member of the external additives of the developer having adhered thereto.

In the case of this image forming apparatus, as its operator notices, in a given image yielded by the apparatus, the presence of an image defect, more specifically, a so-called ghost, that is, the phenomenon that the pattern of the image formed during the preceding image formation cycles is faintly visible across the image formed thereafter, the image forming apparatus can be controlled by its operator to operate in the cleaning mode for cleaning the intermediary transferring member, in order to eliminate the cause(s) of the image defect.

However, the above described image forming apparatus is problematic in that there are situations in which even if an operator of an image forming apparatus such as the one described above identifies the cause(s) of the abovementioned image defect, and instructs the apparatus to operate in the mode for eliminating the cause of the image defect, the cause of the image defect persists.

In other words, the causes for the formation of a defective image by an image forming apparatus employing an intermediary transferring member are not limited to the substances having adhered to the intermediary transferring member. If a cause of the image defect is one other than the residues having adhered to the intermediary transferring member, the cause of the image defect cannot be eliminated, even if the mode for cleaning the intermediary transferring member is carried out. Moreover, it is very difficult to correctly identify the cause(s) of an image defect.

As the image defects which frequently occur due to the causes other than the above described ones, there are the image defects resulting from the changes in the condition under which a toner image is formed on an image bearing member.

SUMMARY OF THE INVENTION

The primary object of the present invention is to provide an image forming apparatus having a means which enables the user of the image forming apparatus to swiftly eliminate the causes of an image defect, even when it is difficult for the operator to identify the causes of the image defect.

According to an aspect of the present invention, there is provided an image forming apparatus comprising an image bearing member; toner image formation means for forming a toner image on said image bearing member; removing means for removing deposited matter deposited on said image bearing member; detecting means for detecting a toner image to be detected, formed on said toner image formation means; control means for controlling a toner image forming condition of said toner image forming means in accordance with a result of detection of the toner image to be detected by said detecting means; said apparatus being operable in a mode in which said removing means operates to remove the deposition, and said detecting means operates to detect the toner image to be detected, executing means for executing an operation in said mode; and an operating portion for manually starting execution of the operation in said mode by said executing means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

According to the present invention, an image forming apparatus is enabled to be operated in the mode in which the abovementioned adherent residues on the intermediary transferring member are removed by the abovementioned residue removing means, and in which the toner image is detected by the abovementioned detecting means, and also, it is provided with a means for carrying out this mode.

Further, the image forming apparatus is provided with a control portion through which the operator of the image forming apparatus can cause the abovementioned means for carrying out the abovementioned recovery mode to start carrying out the recovery mode.

Therefore, even when the cause of the image defect cannot be identified by an operator, the cause of the image defect can be quickly eliminated.

Hereinafter, the preferred embodiments of the present invention will be described in detail.

Embodiment 1

Next, the first embodiment of the present invention will be described with reference to the appended drawings.

Figure 1:
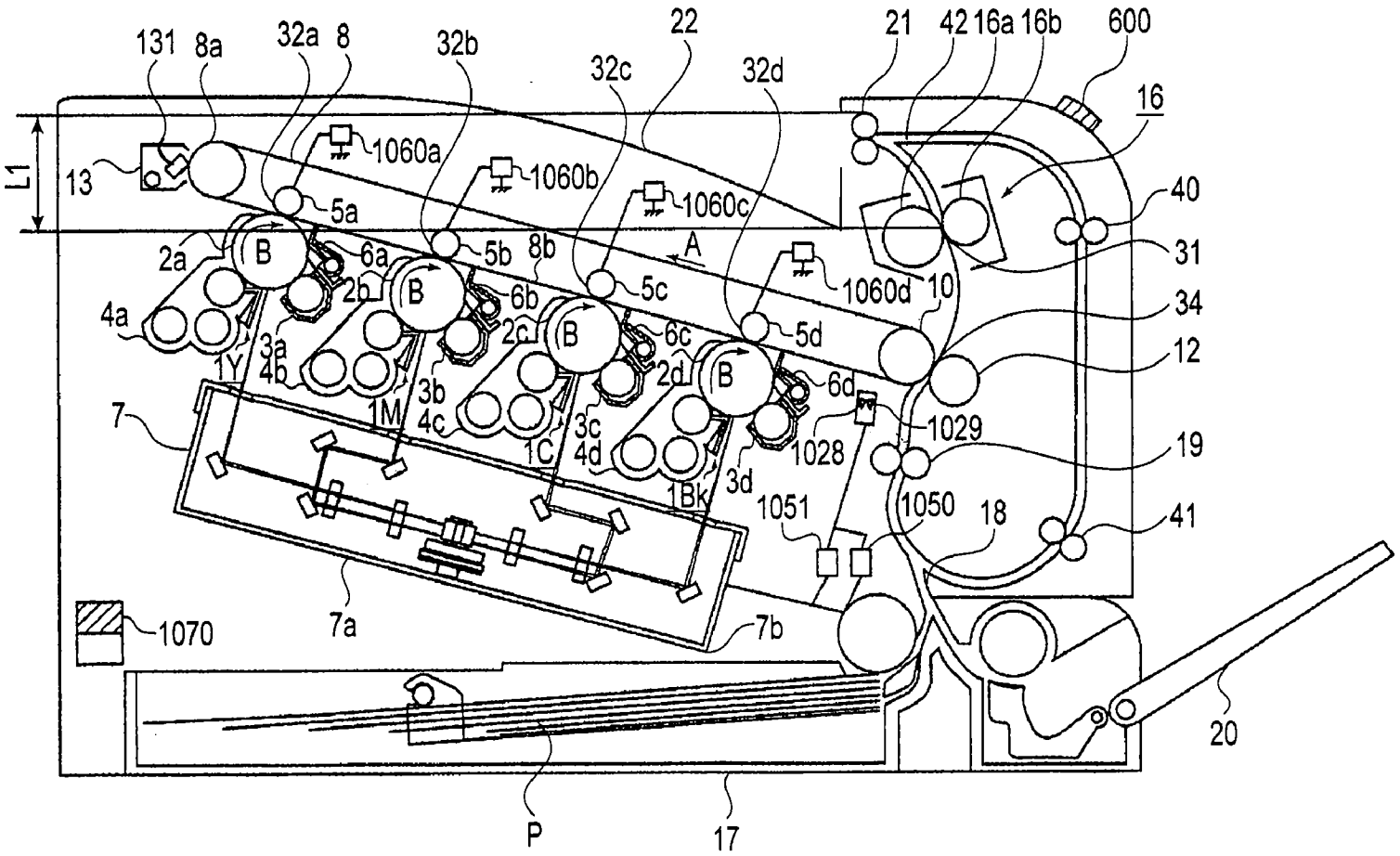
FIG. 1 is a schematic drawing of the image forming apparatus in the first embodiment of the present invention, showing the general structure thereof.

FIG. 1 is a schematic sectional view of a full-color printer as an example of an image forming apparatus. It is provided with four image forming portions (image formation units): an image forming portion 1Y for forming an image for the yellow color; an image forming portion 1M for forming an image of the magenta color; an image forming portion 1C for forming an image of the cyan color; and an image forming portion 1Bk for forming an image of the black color. These four image forming portions 1Y, 1M, 1C, and 1Bk are arranged in a straight line at preset intervals.

The image forming portions (toner image forming means) 1Y, 1M, 1C, and 1Bk are provided with electrophotographic photosensitive members 2*a*, 2*b*, 2*c*, and 2*d* (which hereinafter will be referred to as photosensitive drums), as image bearing members, which are in the form of a drum. They are also provided with primary charging devices 3*a*, 3*b*, 3*c*, and 3*d*, developing apparatuses 4*a*, 4*b*, 4*c*, and 4*d*, transfer rollers 5*a*, 5*b*, 5*c*, and 5*d*, as transferring means, and drum cleaning apparatuses 6*a*, 6*b*, 6*c*, and 6*d*, respectively, which are disposed in the adjacencies of the peripheral surfaces of the photosensitive drums 2*a*, 2*b*, 2*c*, and 2*d* in a manner of surrounding the photosensitive drums 2*a*, 2*b*, 2*c*, and 2*d*, respectively. The image forming apparatus is also provided with an exposing apparatus 7 based on a laser, which is disposed below the space in which the primary charging devices 3*a*, 3*b*, 3*c*, and 3*d*, and developing apparatuses 4*a*, 4*b*, 4*c*, and 4*d* are disposed. Further, the image forming apparatus is provided with an electric power switch 1070 as a means for turning on the image forming apparatus.

In the developing apparatuses 4*a*, 4*b*, 4*c*, and 4*d*, yellow, magenta, cyan, and black toners are stored, respectively.

As the image forming apparatus is turned on with the use of the switch 1070, the image forming apparatus starts up.

Each of the photosensitive drums 2*a*, 2*b*, 2*c*, and 2*d* is made up of an aluminum substrate in the form of a drum, and a photoconductive layer formed on the peripheral surface of the substrate, of a negative organic photoconductive substance. Each of the photosensitive drums 2*a*, 2*b*, 2*c*, and 2*d* is rotationally driven by a driving apparatus (unshown) at a preset process speed in the direction indicated by an arrow mark (clockwise direction of FIG. 1).

The primary charging devices 3*a*, 3*b*, 3*c*, and 3*d* as primary charging means negatively and uniformly charge the peripheral surfaces of the photosensitive drums 2*a*, 2*b*, 2*c*, and 2*d*, respectively, to a preset potential level, with the use of the charge bias applied from a charge bias power source (unshown).

The developing apparatuses 4*a*, 4*b*, 4*c*, and 4*d* contain toner, and develop the electrostatic latent images formed on the peripheral surfaces of the photosensitive drums 2*a*, 2*b*, 2*c*, and 2*d*, into visible images (images formed of toner) by adhering the toners of the corresponding colors, respectively.

The transfer rollers 5*a*, 5*b*, 5*c*, and 5*d* as primary transferring means are disposed so that they can be pressed against the peripheral surfaces of the photosensitive drums 2*a*, 2*b*, 2*c*, and 2*d*, with an intermediary transfer belt 8 sandwiched between the peripheral surfaces of the transfer rollers 5*a*, 5*b*, 5*c*, and 5*d* and the peripheral surfaces of the photosensitive drums 2*a*, 2*b*, 2*c*, and 2*d*, in primary transfer portions 32*a*, 32*b*, 32*c*, and 32*d*, respectively.

The drum cleaning apparatuses 6*a*, 6*b*, 6*c*, and 6*d* are provided with a cleaning blade, or the like, for removing the residual toner, that is, the toner remaining on the peripheral surface of the photosensitive drums 2 after the primary transfer.

The intermediary transfer belt 8 is disposed on the top side of the space in which the photosensitive drums 2*a*, 2*b*, 2*c*, and 2*d* are disposed, and is stretched around a pair of rollers 10 and 11. The roller 10 is the one which opposes the secondary transfer roller 12, with the intermediary transfer belt 8 sandwiched between the two rollers, and the roller 11 is a tension roller. The roller 10 is disposed so that it can be pressed against the peripheral surface of the secondary transfer roller 12, with the intermediary transfer belt 8 sandwiched between the rollers 10 and 12. The intermediary transfer belt 8 is an endless piece of film formed of a dielectric resin such as polycarbonate, polyethylene terephthalate, polyfluorovinylidene, or the like.

Further, the intermediary transfer belt 8 is extended at such an angle that the portions of the intermediary transfer belt 8, which are in contact with the peripheral surfaces of the photosensitive drums 2*a*, 2*b*, 2*c*, and 2*d*, are positioned higher than the portion of the intermediary transfer belt 8, which is in contact with the secondary transfer roller 12.

In other words, the intermediary transfer belt 8 is angled so that the downwardly facing portion 8*b* of the outward surface (in terms of the loop which intermediary transfer belt 8 forms) of the intermediary transfer belt 8, that is, the portion of the outward surface of the intermediary transfer belt 8, with which each of the photosensitive drums 2*a*, 2*b*, 2*c*, and 2*d* comes into contact, by the top portion of its peripheral surface, as the intermediary transfer belt 8 is rotationally driven, is positioned higher than the portion of the outward surface of the intermediary transfer belt 8, which is in the secondary transfer portion 34. More specifically, the intermediary transfer belt 8 is stretched at roughly 15°. Further, the intermediary transfer belt 8 is kept stretched by two rollers: the aforementioned roller 10, which opposes the secondary transfer roller 12, and is disposed on the secondary transfer portion side to drive the intermediary transfer belt 8; and the tension roller 11 disposed on the opposite side of the intermediary transfer belt 8 from the roller 10, with the primary transfer portions 32*a*-32*d* positioned between the two rollers 10 and 12 in terms of the direction in which the intermediary transfer belt 8 is stretched.

The roller 10 (secondary transferring means) is disposed so that it can be pressed against the secondary transfer roller 12, with the intermediary transfer belt 8 sandwiched between the two rollers 10 and 12. Disposed in the adjacencies of the tension roller 11 and outward side of the loop which the endless intermediary transfer belt 8 forms is a belt cleaning apparatus 13 for recovering the transfer residual toner remaining on the outwardly facing surface of the intermediary transfer belt 8, by removing it from the intermediary transfer belt 8. The belt cleaning apparatus 13 removes residues other than the transfer residual toner, which have adhered to the intermediary transfer belt 8, as well as the transfer residual toner. Disposed on the downstream side of the secondary transfer portion 34, in terms of the direction in which a transfer medium P is conveyed, is a fixing apparatus, which is made up of a fixation roller 16*a* and a pressure roller 16*b*, and through which the recording medium P is vertically conveyed.

The exposing apparatus 7 is made up of: a light emitting means based on a laser, which emits beams of laser light, while modulating them with sequential electrical digital video signals in accordance with the image formation data; a polygon lens; a deflection mirror, etc. It forms electrostatic latent images different in the primary colors they correspond, on the peripheral surfaces of the photosensitive drums 2*a*, 2*b*, 2*c*, and 2*d*, which have been charged by the primary charging devices 3*a*, 3*b*, 3*c*, and 3*d*, according to the image formation data, by exposing the charged peripheral surfaces of the photosensitive drums 2*a*, 2*b*, 2*c*, and 2*d*, respectively.

Next, the image forming operation of the above described image forming apparatus will be described.

As an image formation start signal is issued, the photosensitive drums 2*a*, 2*b*, 2*c*, and 2*d* begin to be rotationally driven at a preset process speed. As they are rotationally driven, they are uniformly charged to the negative polarity, by the primary charging devices 3*a*, 3*b*, 3*c*, and 3*d*, in the image forming portions 1Y, 1M, 1C, and 1Bk, respectively. The exposing apparatus 7 emits beams of laser light while modulating them with the externally inputted video signals, which reflect the primary color components into which the image formation data have been converted. The emitted beams of laser light are transmitted by way of the polygon lens, deflection mirror, etc., illuminating thereby the peripheral surfaces of the photosensitive drums 2*a*, 2*b*, 2*c*, and 2*d*. As a result, electrostatic latent images, which correspond one for one to the primary colors, are formed on the peripheral surface of the photosensitive drums 2*a*, 2*b*, 2*c*, and 2*d*, one for one.

Then, the toner of the yellow color is adhered to the electrostatic latent image on the photosensitive drum 2*a* by applying to the developing apparatus 4*a* a development bias, the polarity of which is the same (negative) as that to which the photosensitive drum 2*a* has been charged; the electrostatic latent image on the peripheral surface of the photosensitive drum 2*a* is developed into a visible image, that is, an image formed of toner. This image formed of the yellow toner (which hereinafter will be referred to simply as yellow toner image) is transferred (primary transfer) by the application of the primary transfer bias (opposite (positive) in polarity to toner) onto the intermediary transfer belt 8, which is being circularly driven, in the primary transfer portion 32*a*, which is between the photosensitive drum 2*a* and transfer roller 5*a*. The primary transfer bias is applied to the transfer roller 5*a* from a primary transfer bias power source 1060*a*.

The portion of the intermediary transfer belt 8, onto which the yellow toner image has just been transferred, is moved toward the image forming portion 1M, in which the toner image of the magenta color having just formed on the photosensitive drum 2*b* is layered onto the yellow toner image on the intermediary transfer belt 8, in the primary transfer portion 32*b*.

The transfer residual toner, that is, the toner remaining on each of the photosensitive drums 2*a*, 2*b*, 2*c*, and 2*d* after the toner image transfer, is scraped down by the cleaning blade, or the like, with which each of the drum cleaning apparatus 6*a*, 6*b*, 6*c*, and 6*d* is provided, and then, is recovered.

Similarly, the toner image of the cyan color, and the toner image of the magenta color, which have been formed on the photosensitive drums 2*c* and 2*d* in the image forming portions 1C and 1Bk, respectively, are sequentially transferred in layers, in the primary transfer portions 32*c*-32*d*, respectively, onto the yellow and magenta toner images having been layered on the peripheral surface of the intermediary transfer belt 8. As a result, a full-color image, that is, a visible image of full-color, is formed, on the intermediary transfer belt 8.

Meanwhile, a transfer medium P (sheet of paper) is fed into the main assembly of the image forming apparatus from a sheet feeder cassette 17 or a manual sheet feeder tray 20, and then, is conveyed by a pair of registration rollers 19 through a recording medium conveyance passage 18 (sheet passage) to the second transfer portion 34, with such timing that as the leading edge of the full-color toner image on the intermediary transfer belt 8 arrives at the secondary transfer portion 34, that is, the interface between the aforementioned roller 10 and secondary transfer roller 12, the recording medium P reaches the secondary transfer portion 34 at the same time. In the secondary transfer portion 34, the full-color image, that is, the combination of the layered four toner images different in color, is transferred (secondary transfer) onto the transfer medium P, by the secondary transfer roller 12, to which the secondary transfer bias (which is opposite (positive) in polarity to toner) is being applied, as the recording medium P is conveyed through the secondary transfer portion 34. As the secondary transfer roller 12, an electrically conductive rubber roller formed of sponged rubber or the like is employed.

After the formation (transfer) of the full-color toner image onto the transfer medium P, the transfer medium P is conveyed to the fixing apparatus 16, in which the full-color toner image is heated, while being compressed, in the fixation nip between the fixation roller 16*a* and pressure roller 16*b*. As a result, the full-color toner image is thermally fixed to the surface of the transfer medium P. Thereafter, the recording medium P is discharged by a pair of sheet discharge rollers 21 onto the delivery tray 22, which constitutes a part of the top portion of the main assembly of the image forming apparatus, ending thereby the image formation sequence. As for the secondary transfer residual toner, that is, the toner remaining on the intermediary transfer belt 8 after the secondary transfer, is removed by a cleaning apparatus 13 as a toner removing means disposed in contact with the surface of the intermediary transfer belt 8, in order to prepare the intermediary transfer belt 8 for the formation of the next image. The cleaning apparatus 13 in this embodiment employs the blade-based cleaning method; a blade 131 formed of urethane rubber is placed in contact with the intermediary transfer belt 8 with the application of a preset amount of pressure.

The steps described above are the steps for forming an image on only one of the two surfaces of the recording medium P (one-sided image formation).

Figure 2:
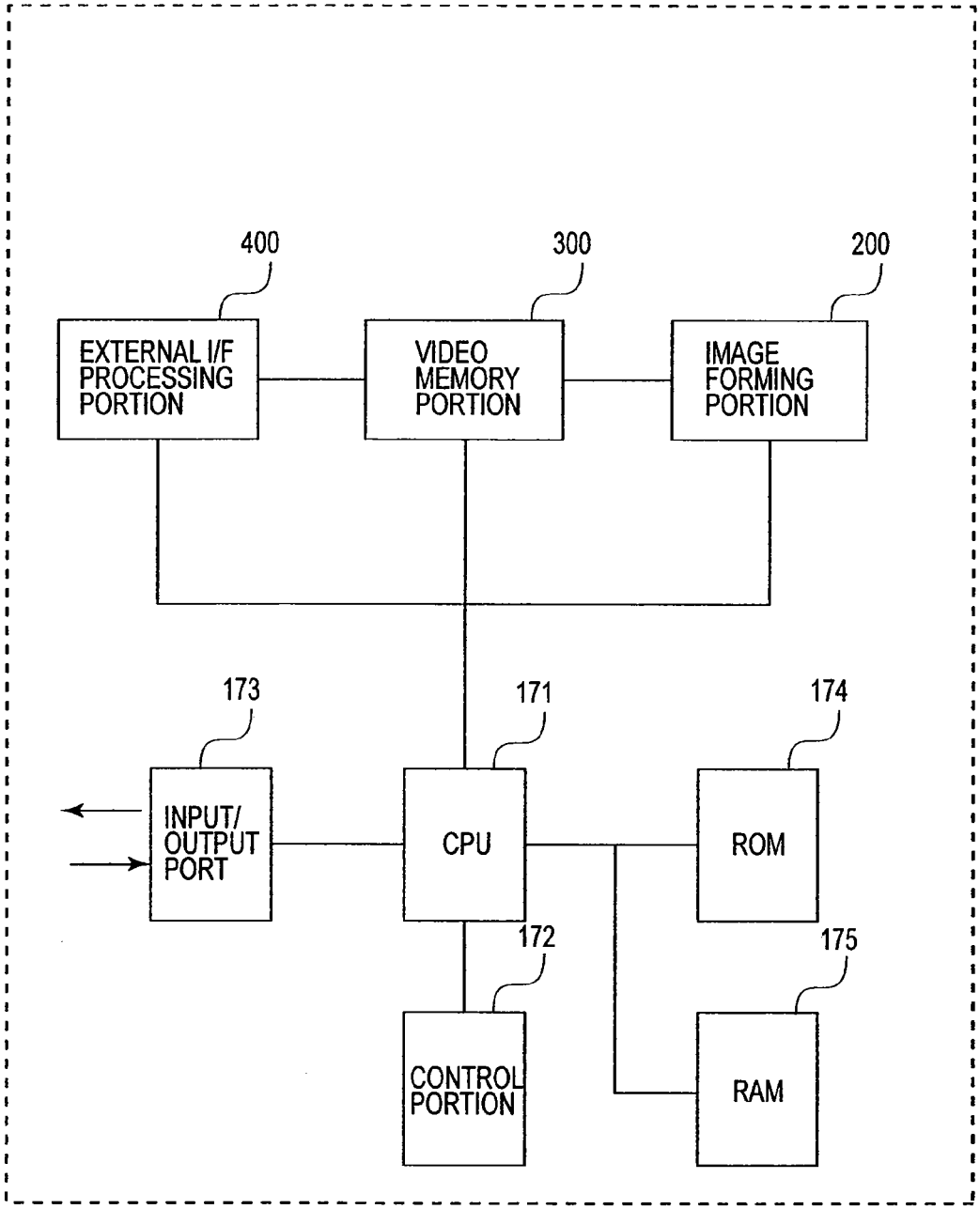
FIG. 2 is a block diagram of the sequence for controlling the image forming operation of the image forming apparatus in the first embodiment of the present invention.

FIG. 2 is a block diagram showing the basic image forming operation of the image forming apparatus. Designated by a referential symbol 171 is a CPU which controls the basic operation of the image forming apparatus, to which a ROM 174, in which the control programs are stored, a work RAM 175 for data processing, and an input/output port 178, are connected through an address bus and a data bus. To the input/output port 173, a sensor (unshown) for detecting the recording sheet position, or the like means, are connected to input the signals therefrom for controlling motors, clutches, and the like (unshown), into the CPU 171, which uses the signals (inputs) to control the operation of the image forming apparatus.

More specifically, the CPU 171 sequentially controls the inputs thereto and outputs therefrom, in order to control the image forming operation, according to the contents of the ROM 174, through the input/output port 173. Also to the CPU 171, a control portion 172 is connected, so that it is enabled to control the displaying means of the control portion 172, and inputting means (key pad or the like). It is through the inputting means (key pad or the like) that an operator is to instruct the CPU 171 to switch the image formation mode, and/or display mode. The CPU 171 displays the condition of the image forming apparatus, and the operational mode set by the operator through the inputting means (key pad or the like). Also connected to the CPU 171 are: an external I/F processing portion 400 for exchanging (transmitting or receiving) the image formation data and/or the data to be processed, with external devices such as a personal computer; a video memory portion 300 used for image expansion, or temporarily storing image formation data; and an image forming portion 200 by which the sequential image formation data transferred from the video memory portion 300 are processed for exposing the photosensitive drums 2 with the use of the exposing apparatus 7.

Figure 3:
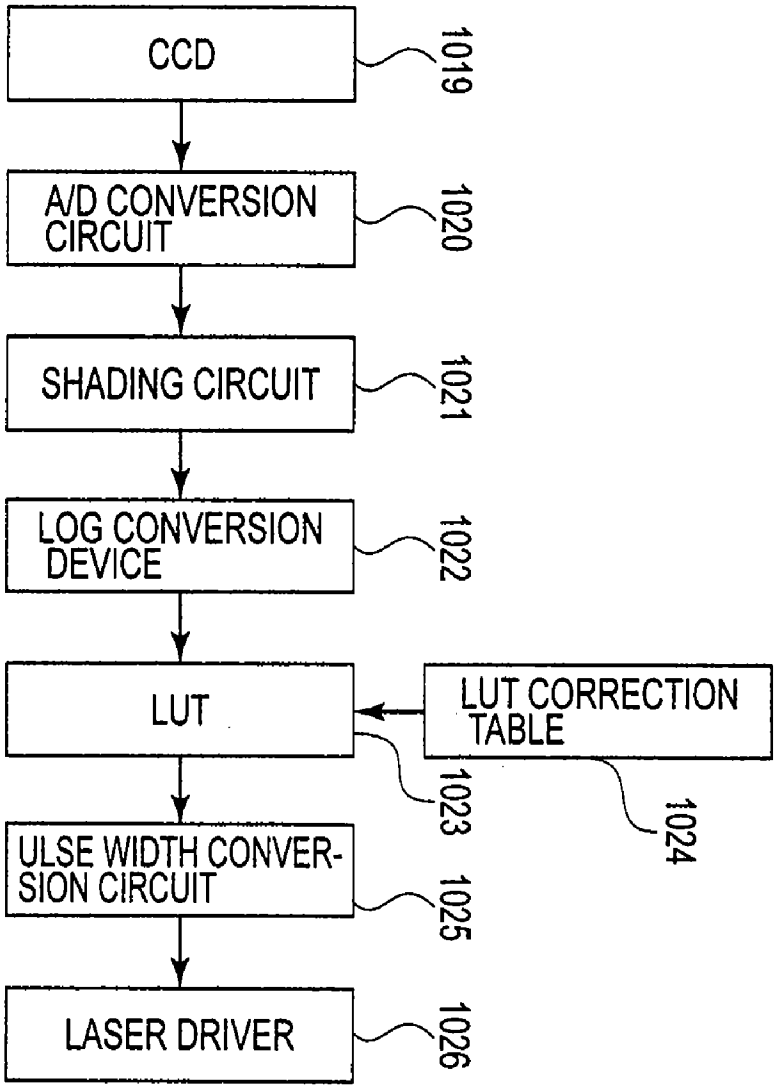
FIG. 3 is a block diagram of the sequence for controlling the tone gradation of the image forming apparatus in the first embodiment of the present invention.

The image forming apparatus in this embodiment is enabled to reproduce various levels of tone. The process carried out by this image forming apparatus in order to reproduce various level of tone will be described with reference to the block diagram, in FIG. 3, of the toner reproduction process.

The luminance signals of an intended image are obtained by a CCD 1019, and the obtained luminance signals are converted into digital luminance signals by an A/D conversion circuit 1020. Then, the digital luminance signals are sent through a shading circuit 1021 which rectifies the errors in the digital luminance signals resulting from the variation in the sensitivity of a CCD. Then, the rectified digital luminance signals are sent through a LOG conversion device 1022 to convert the rectified digital luminance signals into density signals.

The density signals obtained through the LOG conversion device 1022 are rectified using an LUT 1023 in order to ensure that the Y property of the printer, which is selected at the initialization of the printer, is such that the original and the image outputted by the image forming apparatus match in density. The LUT 1023 is designed to be corrected using an LUT correction table 1024 yielded as the results of a computation which will be described later.

After being rectified with the use of the abovementioned LUT 1023, the density signals are converted by a pulse width conversion circuit 1025 into signals, each of which matches the width of the corresponding dot, and then, are sent to a laser driver 1026, which projects a beam of laser light, while modulating it with the thus obtained digital signals, to scan (expose) the photosensitive drums 2 (2*a*, 2*b*, 2*c*, and 2*d*). As a result, a latent image is formed of a collection of dots different in size, on each of the photosensitive drums 2, and each of the latent images is put through the developing process, transferring process, and fixing process. Consequently, an image, the tone gradation of which matches that of the original, is formed on the aforementioned recording medium P.

In this embodiment, the level of the abovementioned density signal is expressed using 8 bits. In other words, the density is expressed in 256 levels. In order to realize a desired level of density, the image forming apparatus is controlled in terms of toner image density.

Figure 4:
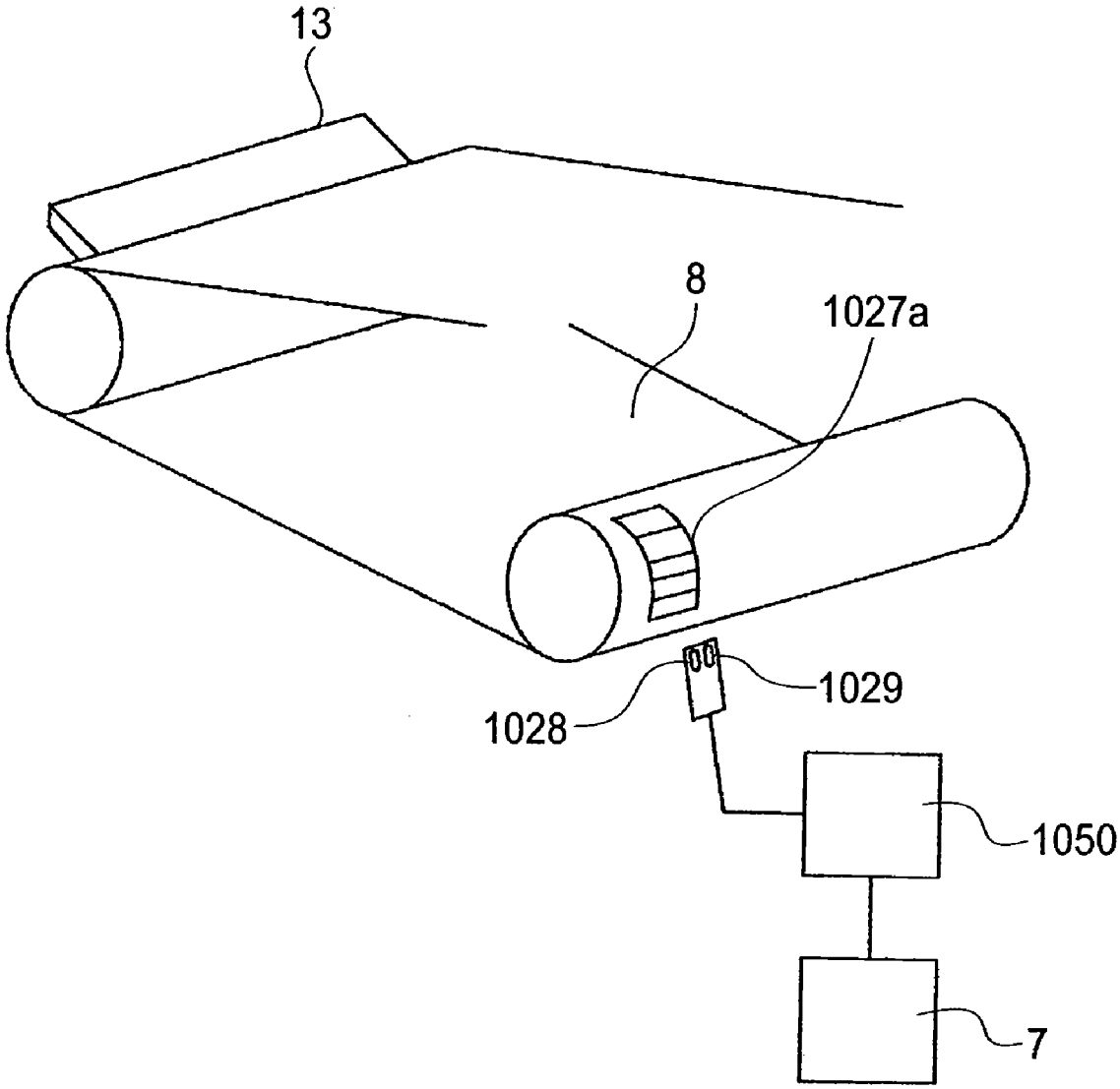
FIG. 4 is a drawing showing the toner image formation condition control pattern of the image forming apparatus in the first embodiment of the present invention.

The method for controlling the image forming apparatus in toner image density is as follows:

Referring to FIG. 4, a toner image condition control pattern (toner image to be detected) 1027*a* made up of five sections different in density level (section with density level of 00H, section density level of 40H, section with density level of 80H, section with density level of COH, and section with density level of FFH) is formed on the photosensitive drum 2, and then, is transferred onto the intermediary transfer belt 8.

Incidentally, this image forming apparatus is provided with an internal test pattern generator capable of generating on the photosensitive drums 2 (2*a*, 2*b*, 2*c*, and 2*d*) one of multiple test patterns different in density signal level.

Figure 5:
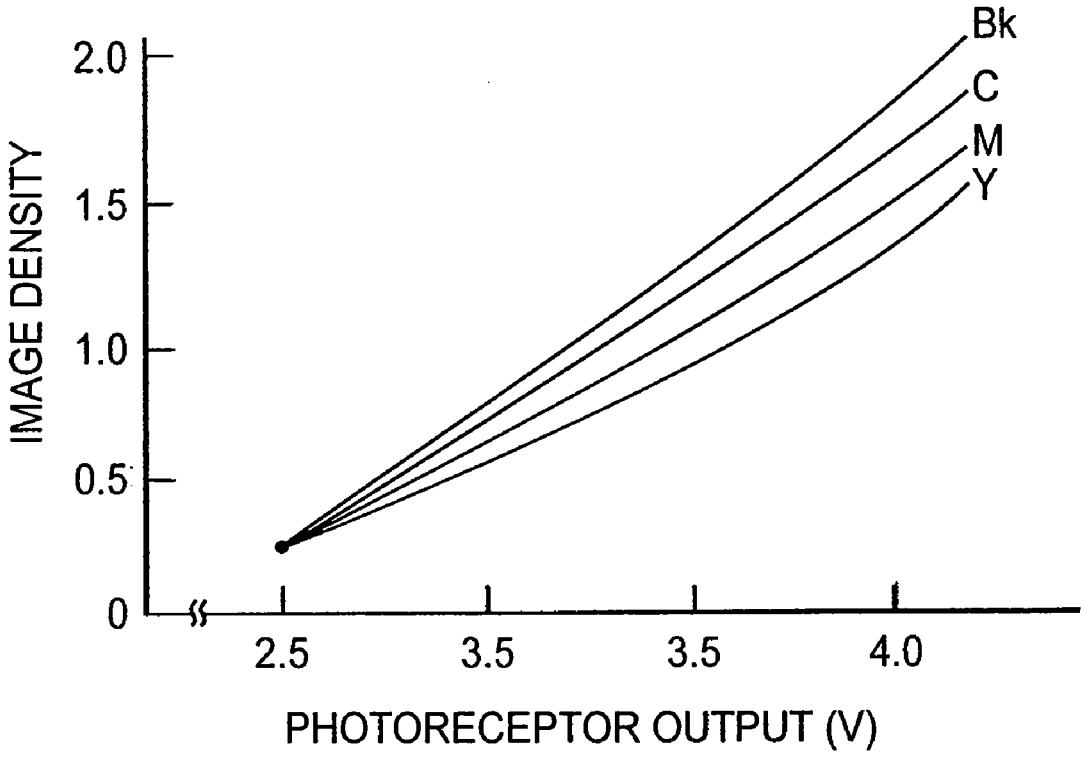
FIG. 5 is a graph showing the relationship between the density level of the image outputted in each of the primary colors and the corresponding output of the photosensitive element.

The images of the toner image density control pattern 1027*a* formed on the photosensitive drums 2 as described above are sequentially transferred onto the intermediary transfer belt 8, and then, the optical density of each of the five sections of the image of the toner image density control pattern 1027*a* is synchronously detected by the combination of a light emitting element 1028 and a photosensitive element 1029, as a toner image detecting means, which outputs signals proportional to the detected level of the optical density. FIG. 5 is a graph showing the relationship between the density of each of the outputted images of the toner image density control pattern 1027*a*, which are different in color, and the corresponding output of the photosensitive element 1029, in this embodiment.

Based on the results of the detection by the combination of the light emitting element 1028 and photosensitive element 1029, as a detecting means, the toner image density controlling means 1050 controls the lookup table (which hereinafter will be referred to as LUT), controlling thereby the image forming apparatus in terms of toner image density.

Next, the details of the control method carried out by the toner image density controlling means 1050 will be described.

Referring to the block diagram in FIG. 6, the method for creating the table 1024 for correcting the LUT, by processing the signals outputted by the abovementioned photosensitive element 1029, which detects (reads) the optical density of a toner image, will be described. The signals outputted by the photosensitive element 1029 are converted by an A/D conversion device 1030, into digital signals, which are converted by a density conversion circuit 1031, into density signals.

Figure 7:
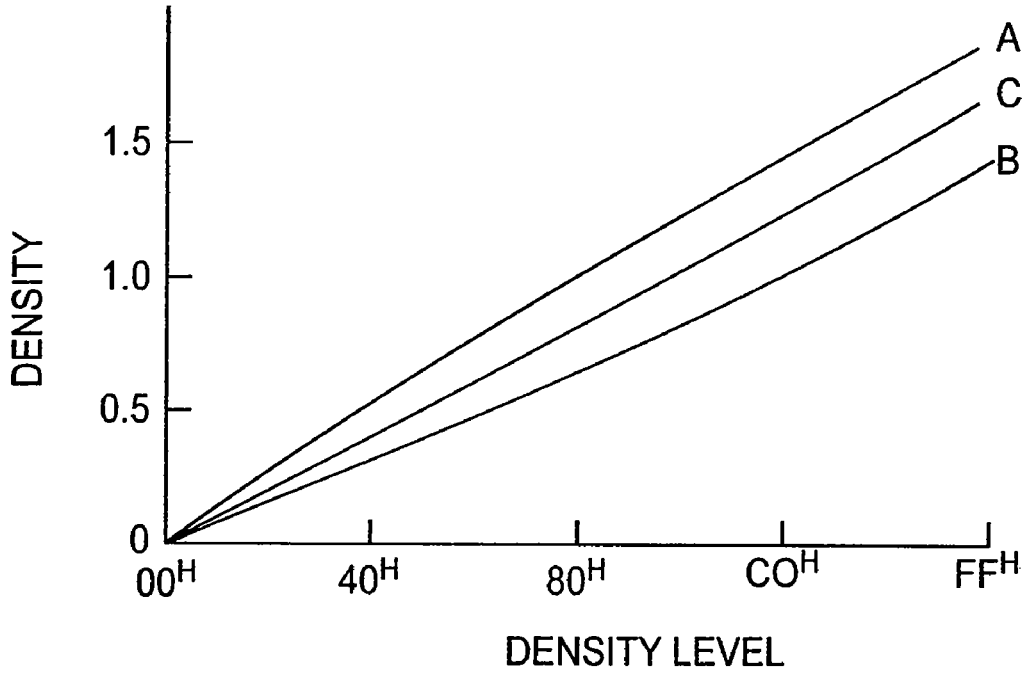
FIG. 7 is a graph showing the relationship in density level between the theoretical toner image formation condition control pattern and the pattern used for controlling the toner image formation conditions, and the density level of the resultant image.

During the initial setting of the Y property of the image forming apparatus (printer), the image forming apparatus is set according to the LUT so that the relationship between the density of the toner image density control pattern 1027*a* and the density of the image of the toner image density control pattern becomes linear (curved line C in FIG. 7). However, the photosensitive drums 2 (2*a*, 2*b*, 2*c*, and 2*d*) change in such properties as sensitivity, developability, etc., due to the changes in the manner in which the toner is supplied, changes in the ambience, and/or the like changes, which occur with the elapse of time, which in turn causes the abovementioned relationship between the density of the toner image density control pattern 1027*a* and the density of the image thereof, to deviate from the relationship represented by the curved line C; it changes to that represented by a curved line A or that represented by a curved line B, for example.

Figure 8:
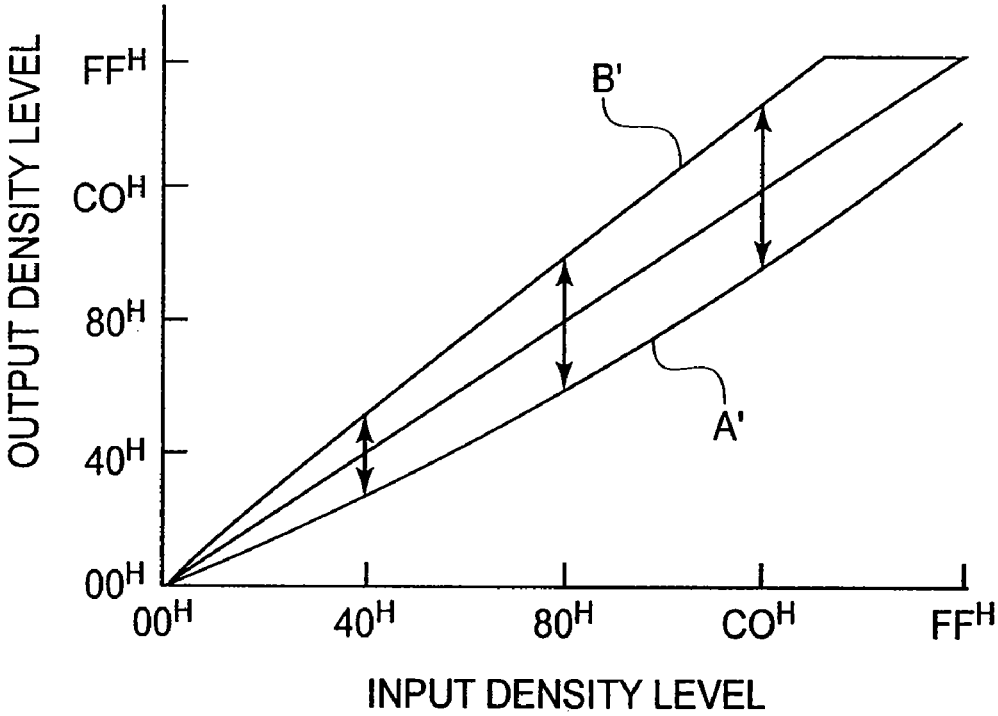
FIG. 8 is a graph showing the relationship between the input level and output level.

Thus, if the density levels detected by the photosensitive element 1029 are higher than the intended density levels, as indicated by the curved line A in FIG. 7, a computation is made to lower the values, to which the density levels are set, as shown by the curved line A' in FIG. 8, so that the resultant output density levels will be lower by the amount by which the output density level was higher than the intended density level. Further, if the density levels detected by the photosensitive element 1029 are lower than the intended density levels, as indicated by the curved line B in FIG. 7, a computation is made to raise the values, to which the density levels are set, as shown by the curved line B' in FIG. 8, so that the resultant output density levels will be higher by the amount by which the output density level was lower than the intended density level.

Figure 6:
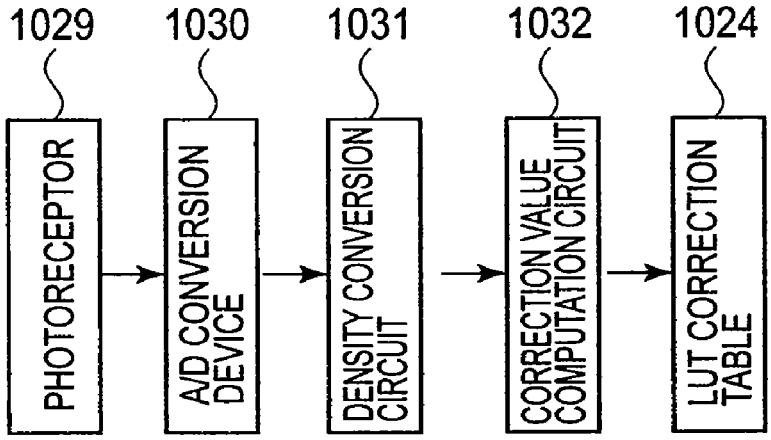
FIG. 6 is a block diagram showing the process for creating a LUT correction table.

For the above described purpose, the LUT correction table 1024 to be used for correcting the LUT table 1023 is created by a correction value computation circuit 1032, which performs the above described computation for obtaining the correction value, based on the density levels calculated by the density conversion circuit 1031 shown in FIG. 6.

The table 1024 for correcting the LUT 1023, which is created through the above described process, is used to correct the LUT 1023, and the corrected LUT 1023 is used to compensate for the toner gradation which has been changed by the abovementioned factors, so that the printer remains constant in terms of the toner gradation. A toner image, the tone gradation of which matches the preset toner gradation, can be formed by carrying out the above described compensation process for each of the primary colors.

The abovementioned values used for the compensation are stored in the unshown RAM of the control portion, and are continuously used until the above described correction process is repeated as it is determined that an outputted toner image is abnormal in density.

Next, the process of controlling the image forming apparatus in toner image position will be described.

Figure 9:
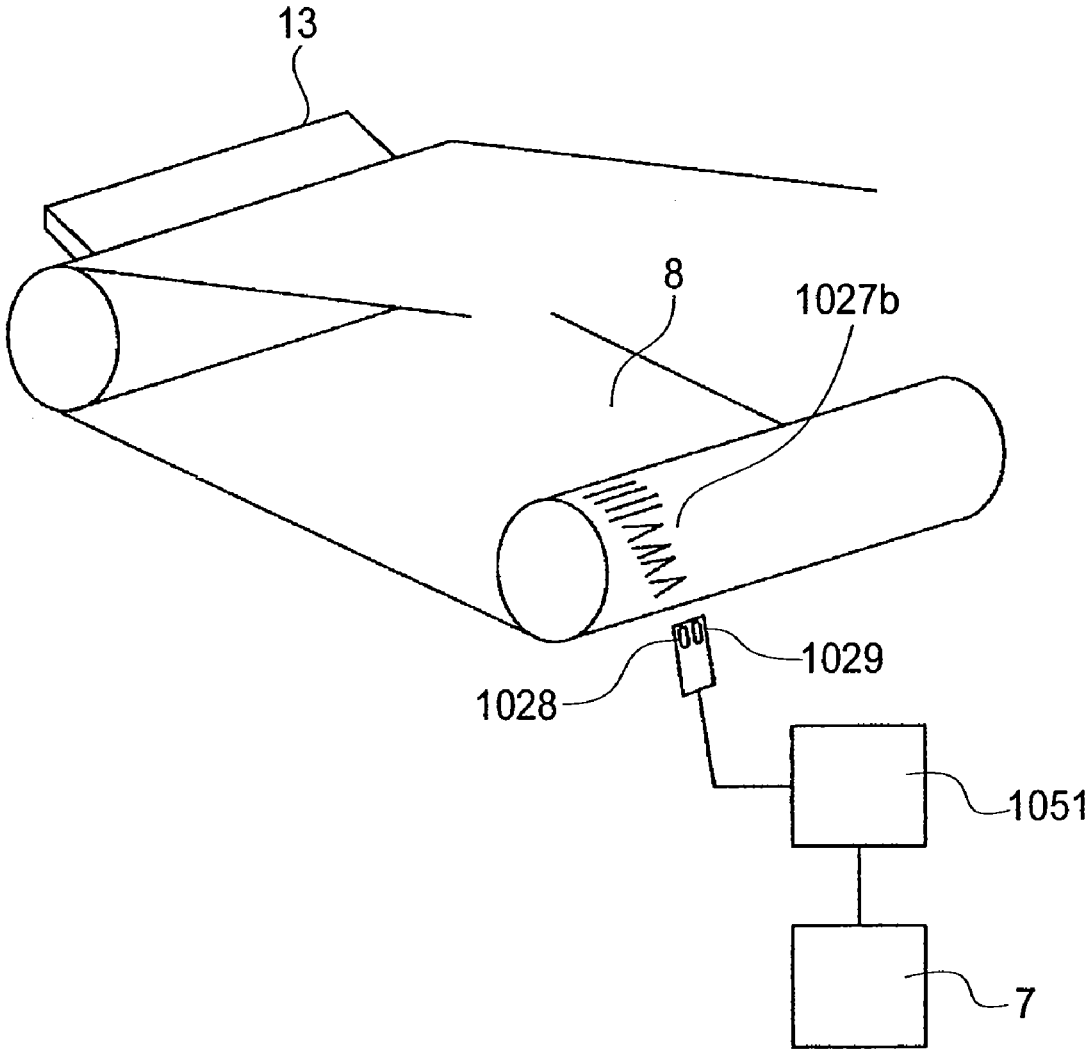
FIG. 9 is a drawing showing the toner image formation position control pattern of the image forming apparatus in the first embodiment of the present invention.

Referring to FIG. 9, a toner image position control pattern 1027*b* (toner image to be detected) is formed across the portion of the intermediary transfer belt 8, which opposes the combination of the light emitting element 1028 and photosensitive element 1029, as a detecting means. The beam of light projected from the light emitting element 1028 onto the toner image position control pattern 1027*b* is reflected by the pattern 1027*b*, and is detected by the photosensitive element 1029.

The results of the detection by the photosensitive element 1029 are used by the toner image position controlling means 1051 to control the image forming apparatus in the position of the portion of each of the photosensitive drums 2, across which each photosensitive drum 2 is exposed by the exposing means 7, controlling thereby the apparatus in the position of the portion of the photosensitive drum 2 across which the toner image is to be formed.

Figure 10:
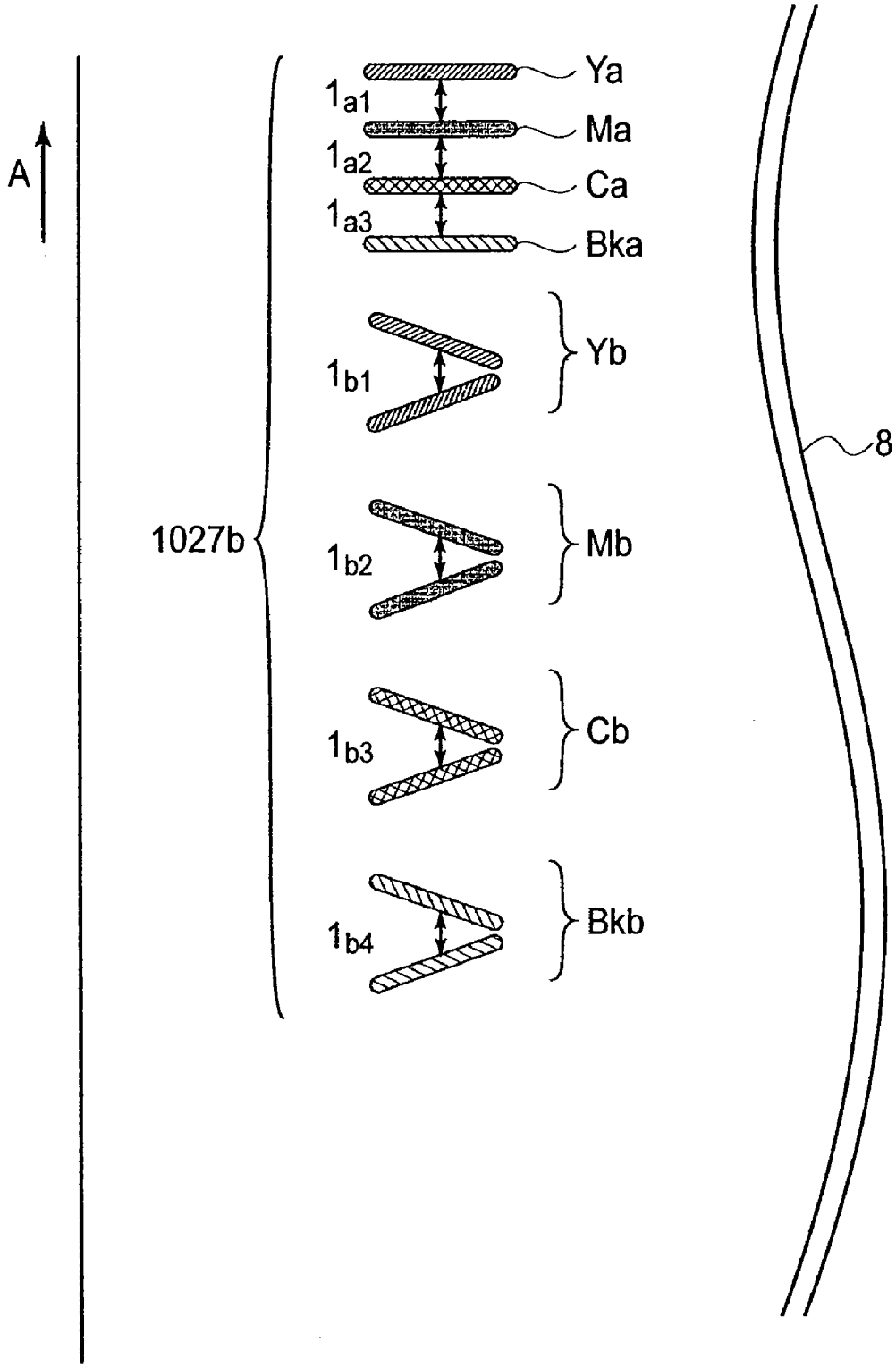
FIG. 10 is drawing showing in detail the toner image formation position control pattern for the image forming apparatus in the first embodiment of the present invention.

Shown in detail in FIG. 10 is the toner image formation position control pattern 1027*b*. In FIG. 10, the patterns Ya, Ma, Ca, and Bka are formed on the intermediary transfer belt 8 by the image forming portions 1Y, 1M, 1C, and 1Bk. The patterns Ya, Ma, Ca, and Bka are straight lines perpendicular to the direction indicated by an arrow mark A, that is, the direction in which the intermediary transfer belt 8 is moved. Further, the patterns Ya, Ma, Ca, and Bka have been formed with a preset timing. Also referring to FIG. 10, designated by referential symbols la1, la2, and la3 are the distances between the patterns Ya and Ma, between the patterns Ma and Ca, and between the patterns Ca and Bka, which are measured by the combination of the light emitting element 1028 and photosensitive element 1029. The theoretical values of the distances la1, la2, and la3 are known from the timing with which the patterns Ya, Ma, Ca, and Bka have been formed.

The toner image formation position controlling means 1051 compares the values of the distances la1, la2, and la3 with their theoretical values, and controls the image forming apparatus in the position of the portion of the intermediary transfer belt 8, across which a toner image is to be formed, in terms of the direction which is parallel with the intermediary transfer belt advancement direction as well as the direction perpendicular thereto. That is, the toner image position controlling means 1051 controls the image forming apparatus in the position of the portion of each of the photosensitive drums 2, across which the photosensitive drum 2 is exposed by the exposing means 7 of each of the image forming portions 1Y, 1M, 1C, and 1Bk, respectively.

Also referring to FIG. 10, the patterns Yb, Mb, Cb, and Bkb are also formed on the intermediary transfer belt 8 by the image forming portions 1Y, 1M, 1C, and 1Bk. Each of the patterns Yb, Mb, Cb, and Bkb is a pair of straight lines inclined at a preset angle relative to the direction perpendicular to the direction indicated by the arrow mark A, which is the direction in which the intermediary transfer belt 8 advances. The patterns Yb, Mb, Cb, and Bkb are formed with a preset timing. Designated by referential symbols lb1, lb2, lb3 and lb4 are the distances between the preset point of one of the pair of straight lines of each of the patterns Yb, Mb, Cb, and Bkb, and that of the other. These distances are measured by the combination of the light emitting element 1028 and photosensitive element 1029. The theoretical values of the distances lb1, lb2, lb3, and lb4 are known from the preset timing with which the patterns Yb, Mb, Cb, and Bkb have been formed.

The toner image formation position controlling means 1051 compares the values of the distances la1, la2, and la3 with their theoretical values, and controls the image forming apparatus in the position of the portion of the intermediary transfer belt 8, across which a toner image is to be formed, in terms of the direction which is parallel with the intermediary transferring member advancement direction as well as the direction perpendicular thereto. That is, the toner image position controlling means 1050 controls the image forming apparatus in the position of the portion of each of the photosensitive drums 2, across which the photosensitive drum 2 is exposed by the exposing means 7 of each of the image forming portions 1Y, 1M, 1C, and 1Bk, respectively.

As described above, the detecting means detects the toner images on the intermediary transfer belt 8. Based on the results of the detection, the toner image density controlling means 1050 and toner image position controlling means 1051, as controlling means, variably control the toner image formation conditions (toner image density, toner image position) for the toner image forming means.

Figure 11:
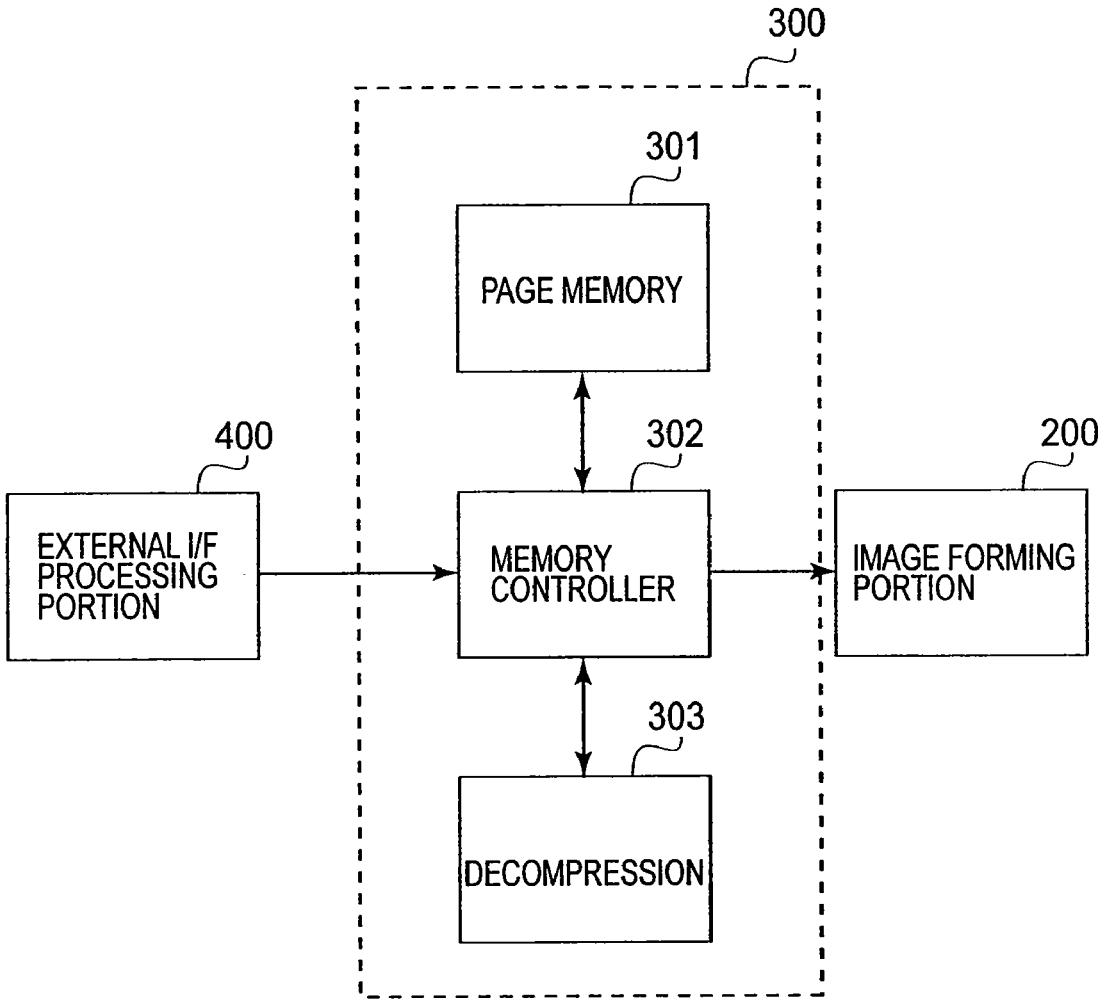
FIG. 11 is a drawing showing the video memory portion of the image forming apparatus in the first embodiment of the present invention.

Next, referring to FIG. 11, the details of the video memory portion 300 will be described. The video memory portion 300 is accessed to write the image formation data received from the external I/F processing portion 400 through a memory controller 302, into a page memory 301, which is such a memory as DRAM, and also, to read the image formation date to provide the image forming portions 2 with the image formation data.

The memory controller portion 302 determines whether or not the image formation data, which it receives from the external I/F processing portion 400, is compressed data. If it determines that the data is compressed data, it expands the compressed data, with the use of a compressed data expanding portion 300. Therefore, it writes the expanded data into the page memory 301.

The memory controller portion 302 also generates a signal for refreshing the page memory 301 in the form of a DRAM or the like. Further, it controls such a process as accessing the page memory 301 to write the data from the external I/F processing portion 400, and to read the data in the page memory 301 to supply the image forming portions 200 with the image formation data. Further, it controls which addresses in the page memory 301 the data are to be written into, which addresses in the page memory 301 the data are to be read from, in which direction the data is to be read, or the like.

Figure 12:
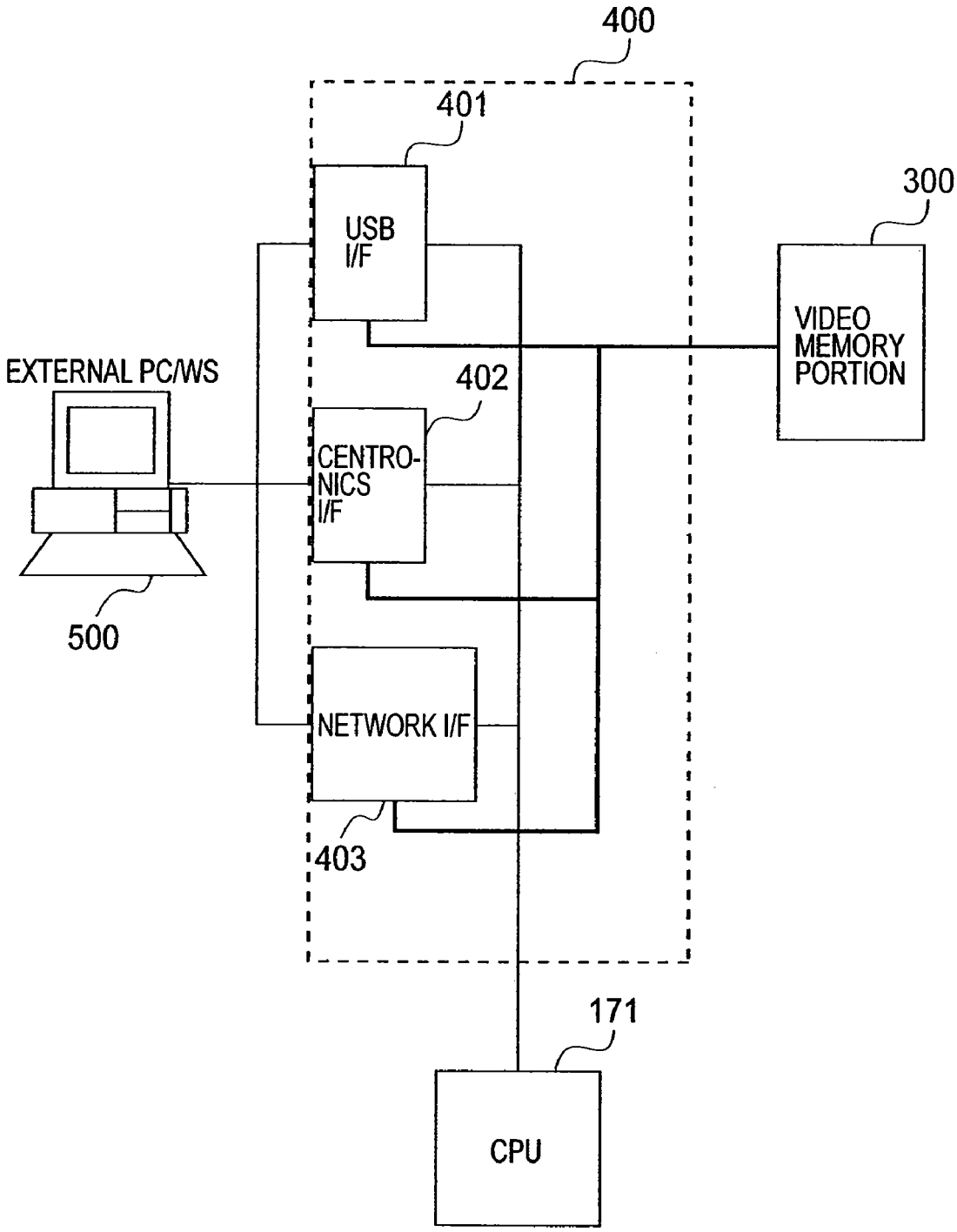
FIG. 12 is a drawing showing the external I/F processing portion of the image forming apparatus in the first embodiment of the present invention.

Next, referring to FIG. 12, the structure of the external I/F processing portion 400 will be described.

The external I/F processing portion 400 is made up of: a USB I/F portion 401, a centro I/F portion 402, and a network I/F portion 403, through one of which the image formation data and print command data sent from the external apparatus 500 are received by the video memory portion 300, or the condition of the image forming apparatus determined by the CPU 171, and the like, are transmitted to the external apparatus 500, which here is a computer, a workstation, or the like.

The print command data received from the external apparatus 500 through one of the USB I/F portion 401, centro I/F portion 402, and network I/F portion 403, are processed by the CPU 171 to be used for setting the image forming portion 200 for carrying out a printing operation, and also, for setting the timing with which the printing operation is carried out, with the use of the image forming portion 200, or through the I/O 173.

The image formation data received from the external apparatus 500 through one of the USB I/F portion 401, centro I/F portion 402, and network I/F portion 403, are transmitted to the video memory portion 300, with the timing set based on the print command data, and are processed by the image forming portion 200 to be used for image formation.

Figure 13:
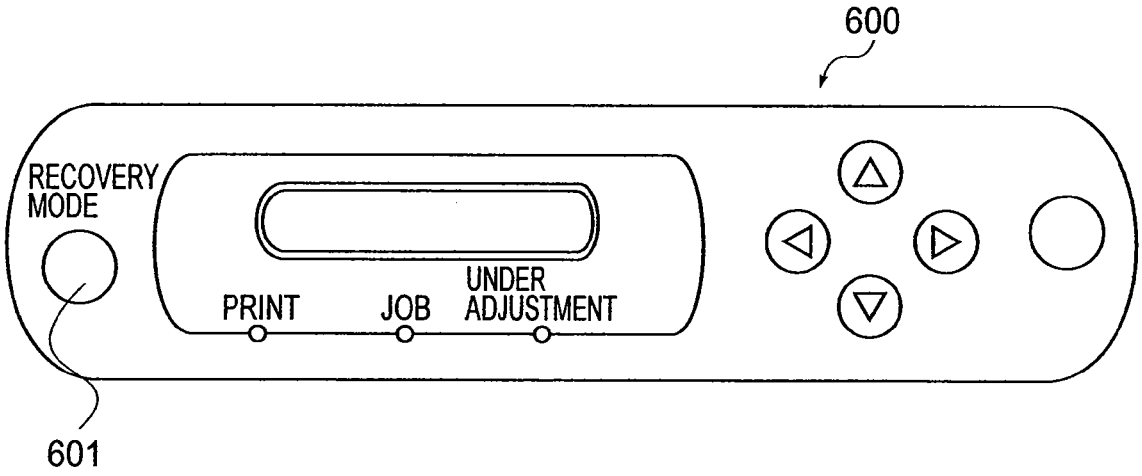
FIG. 13 is a drawing of an example of the control panel of the image forming apparatus in the first embodiment of the present invention.

Next, the recovery mode which is to be used by a user (operator) to eliminate the cause(s) of the formation of an abnormal image, if the user notices the formation of an abnormal image, will be described. The recovery mode is started by a user, by depressing the recovery mode starting means 601, with which the control panel 600 (controlling portion), shown in FIG. 13, of the image forming apparatus is provided, while the image forming apparatus is on, more specifically, while the image forming apparatus is kept on standby. As the recovery mode starting means 601 is depressed, the command data are processed by the CPU 171 (processing means) shown in FIG. 2. The recovery mode is carried out by the image forming portion 200, etc. The image forming apparatus is designed so that the recovery mode can be started at will by a user, by operating the recover mode starting means 601.

Figure 14A:
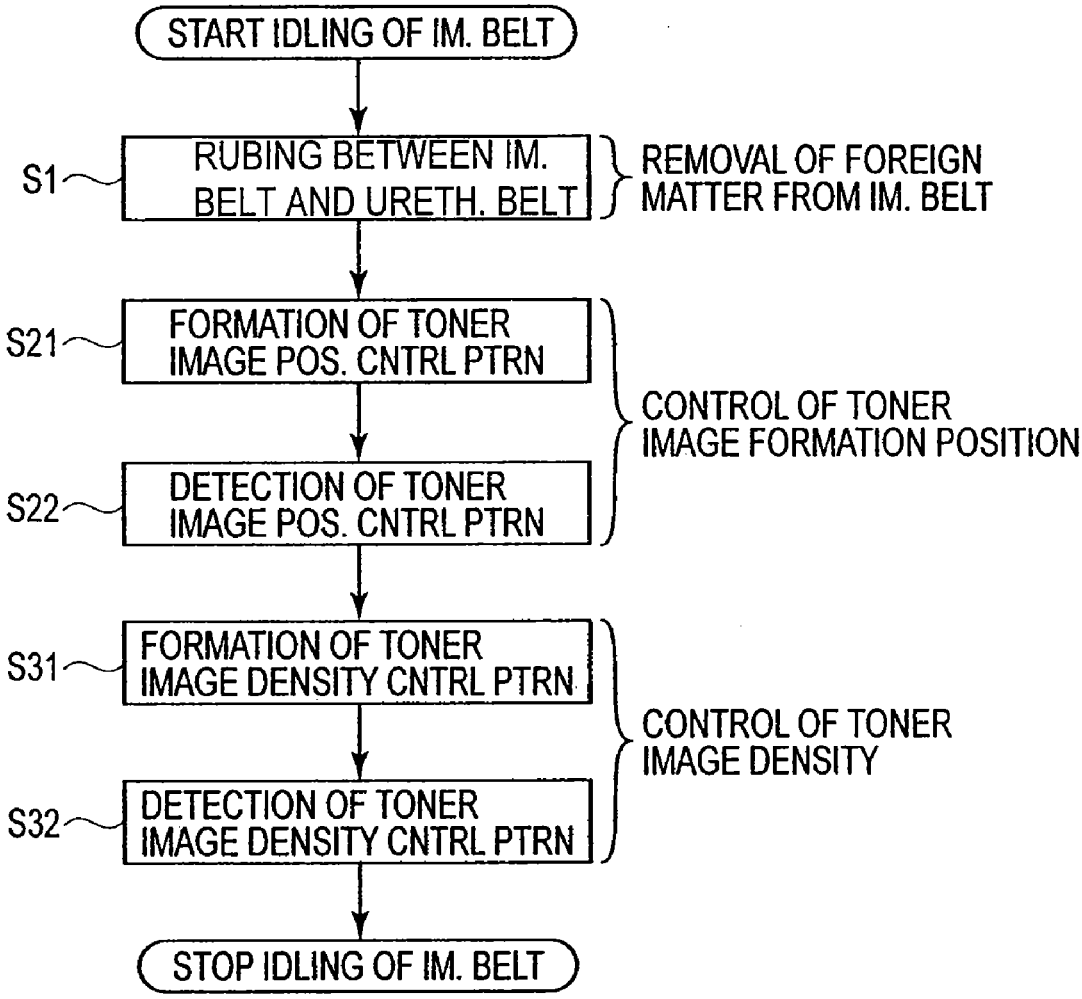
FIG. 14*a* is a flowchart of the recovery mode sequence.

The recovery mode in this embodiment is carried out as follows. FIG. 14*a* is a flowchart of the recovery mode sequence in this embodiment.

In the recovery mode, Step S1 related to the removal of the adherent residues on the intermediary transfer belt 8, Step S2 related to the positioning of a toner image, and Step S3 related to toner density, are sequentially carried out in this order. As the recovery mode is started, the rotation of the intermediary transfer belt 8 is started, and then, as the recovery mode ends, the rotation of the intermediary transfer belt 8 is stopped.

Next, the step (Step S1 in FIG. 14*a*), which is related to the removal of the adherent residues on the intermediary transfer belt 8, and is carried out first, will be described in detail.

As the recovery mode starting means 601 is depressed by a user, the recovery mode begins. First, it is started to drive the intermediary transfer belt 8 in the direction indicated by an arrow mark A. As the intermediary transfer belt 8 is circularly driven, the intermediary transfer belt 8 rubs against the blade 131 (rubber blade) of the cleaning apparatus 13, which is formed of urethane rubber. As a result, the adherent residues on the intermediary transfer belt 8 are removed by the blade 131. It is desired that the intermediary transfer belt 8 is circularly driven no less than one full turn (which requires 2.4 seconds). The longer the length of time the intermediary transfer belt 8 rubs against the urethane rubber blade 131, the more ensured it is that the adherent residues on the intermediary transfer belt 8 are satisfactorily removed. In this embodiment, the intermediary transfer belt 8 is circularly driven 75 times (180 seconds). Incidentally, while the recovery mode is carried out, the intermediary transfer belt 8 is continuously circularly moved.

Further, the presence of the toner between the urethane rubber blade 131 and intermediary transfer belt 8 while the intermediary transfer belt 8 is rubbing against the urethane rubber blade 131 improves the urethane rubber blade 131 in terms of its performance in the removal of the residues on the intermediary transfer belt 8, because the toner acts as an abradant.

Figure 15:
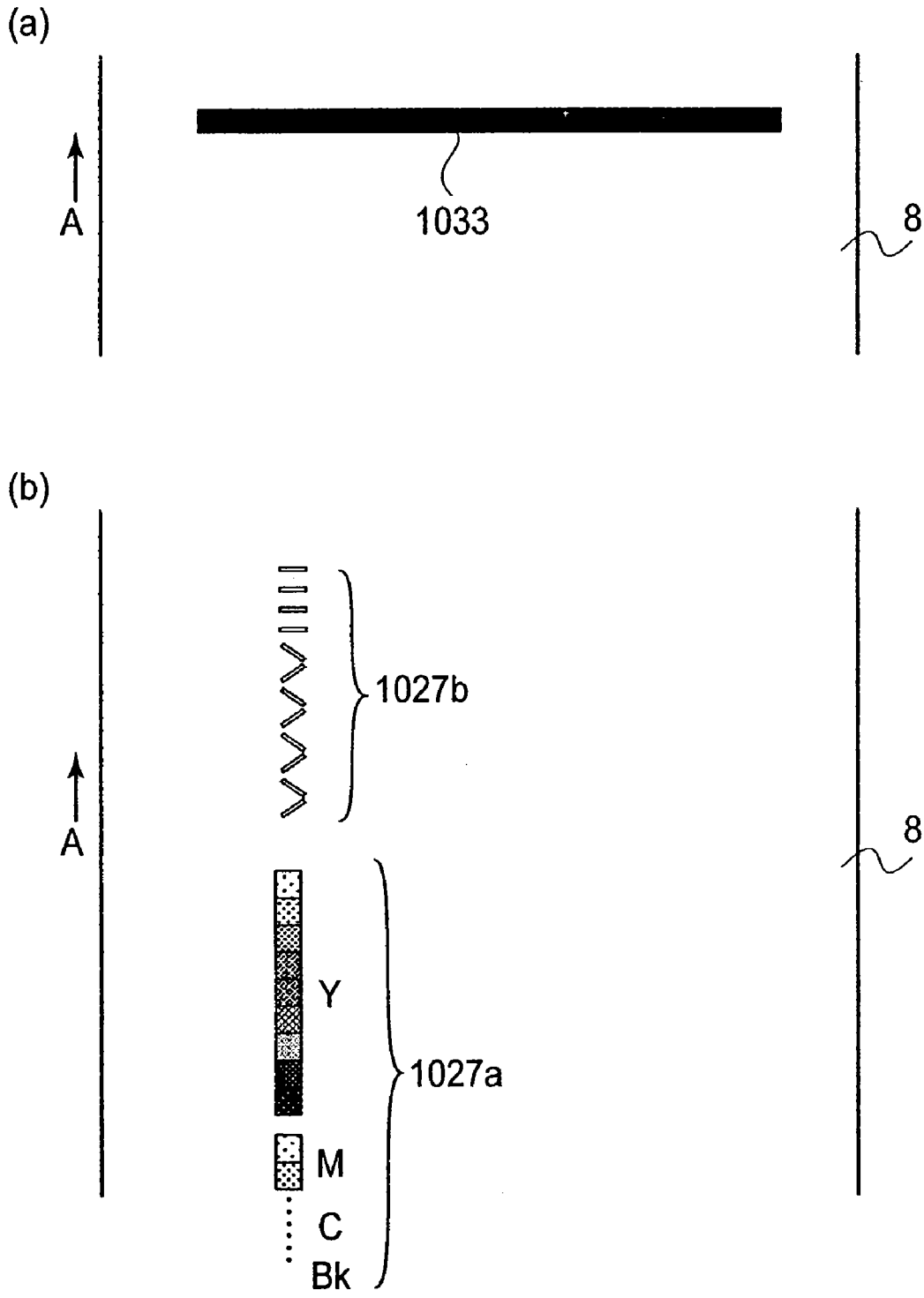
FIG. 15 is a drawing showing the toner image formed on the intermediary transfer belt in the recovery mode.

Referring to FIG. 15(*a*), in this embodiment, therefore, a toner image 1033 for cleaning the intermediary transfer belt 8 is formed on the rotating intermediary transfer belt 8, supplying the interface between the urethane rubber blade 131 and intermediary transfer belt 8 with toner. At this time, the method for supplying the interface between the urethane rubber blade 131 and intermediary transfer belt 8 with toner will be described.

First, the toner image 1033, which is in the form of a band (extending perpendicular to intermediary transfer belt advancement direction), is formed on the rotating intermediary transfer belt 8. Referring to FIG. 15, the length of this toner image 1033, that is, its measurement in terms of the direction perpendicular to the intermediary transfer belt advancement direction, is equivalent to the length of the entirety of the range across which an image can be formed, whereas the width of the toner image 1033, that is, the measurement of the toner image 1033 in terms of the direction parallel to the intermediary transfer belt advancement direction, is roughly 10 cm. The size of the toner image 1033 in the form of a band, and the formation timing therefor, are stored in advance in the video memory portion 300.

While the intermediary transfer belt 8 is circularly driven to supply the interface between the urethane rubber blade 131 and intermediary transfer belt 8 with toner, the process of feeding the image forming apparatus with a sheet of recording medium, process of conveying a sheet of recording medium though the apparatus, and process of transferring a toner image onto a sheet of recording medium, are not carried out, which is different from the normal image forming operation. As the intermediary transfer belt 8 is circularly driven, the toner image 1033 thereon reaches the urethane rubber blade 131, supplying the interface between the urethane rubber blade 131 and intermediary transfer belt 8 with toner.

Next, the step (Steps S21 and S22 in FIG. 14), which is carried out second, will be described.

Referring to FIG. 15(*b*), the toner image position control pattern 1027*b* is formed on the intermediary transfer belt 8 as shown in the drawing (S21). The toner image formation position control pattern 1027*b* is formed on the portion of the intermediary transfer belt 8, which is within the image formation range. The toner image position control pattern 1027*b* is formed on the intermediary transfer belt 8 after the circular driving of the intermediary transfer belt 8 no less than one turn after the formation of the toner image 1033 on the intermediary transfer belt 8. In other words, the toner image formation position control pattern 1027*b* is formed on the portion of the intermediary transfer belt 8, from which the residues have been removed by the cleaning apparatus 13.

Then, the toner image position control pattern 1027*b* is detected by the combination of the light emitting element 1028 and photosensitive element 1029 (S22).

Described next will be the step (Steps S31 and S32) related to the toner density, which is carried out third.

Referring to FIG. 15(*b*), the toner image density control pattern 1027*a* is formed across the portion of the intermediary transfer belt 8, which is on the upstream side of the toner image formation position control pattern 1027*b* in terms of the advancement direction of the intermediary transfer belt 8 as shown in the drawing (Step S31 in FIG. 14*a*). The toner image formation condition control pattern 1027*a* is formed on the portion of the intermediary transfer belt 8, which is within the image formation range. In other words, the toner image density control pattern 1027*a* is formed on the portion of the intermediary transfer belt 8, from which the residues have been removed by the cleaning apparatus 13.

Further, the toner image density control pattern 1027*a* is detected by the combination of the light emitting element 1028 and photosensitive element 1029, as a toner image detecting means (Step S32 in FIG. 14*a*).

As soon as the process for controlling the image forming apparatus in the toner image density is completed, the intermediary transfer belt 8, which has been circularly driven, is stopped, ending thereby the recovery mode.

Then, during the period between the completion of the recovery mode and the formation of the next image, the CPU 171 controls the image forming apparatus in the toner image formation position, and toner image density, based on the results of the detection of the toner image formation position control pattern 1027*a* and toner image density control pattern 1027*a*, respectively.

As described above, with the provision of the recovery mode, in which the residues having adhered to the intermediary transfer belt 8 as an image bearing member are removed; the image forming apparatus can be corrected in the position of the area across which a toner image is formed; and the image forming apparatus is corrected in the density level at which a toner image is formed, a user is enabled to quickly eliminate the cause(s) of the formation of a defective image, even when it (they) cannot be identified by the user.

Figure 14B:
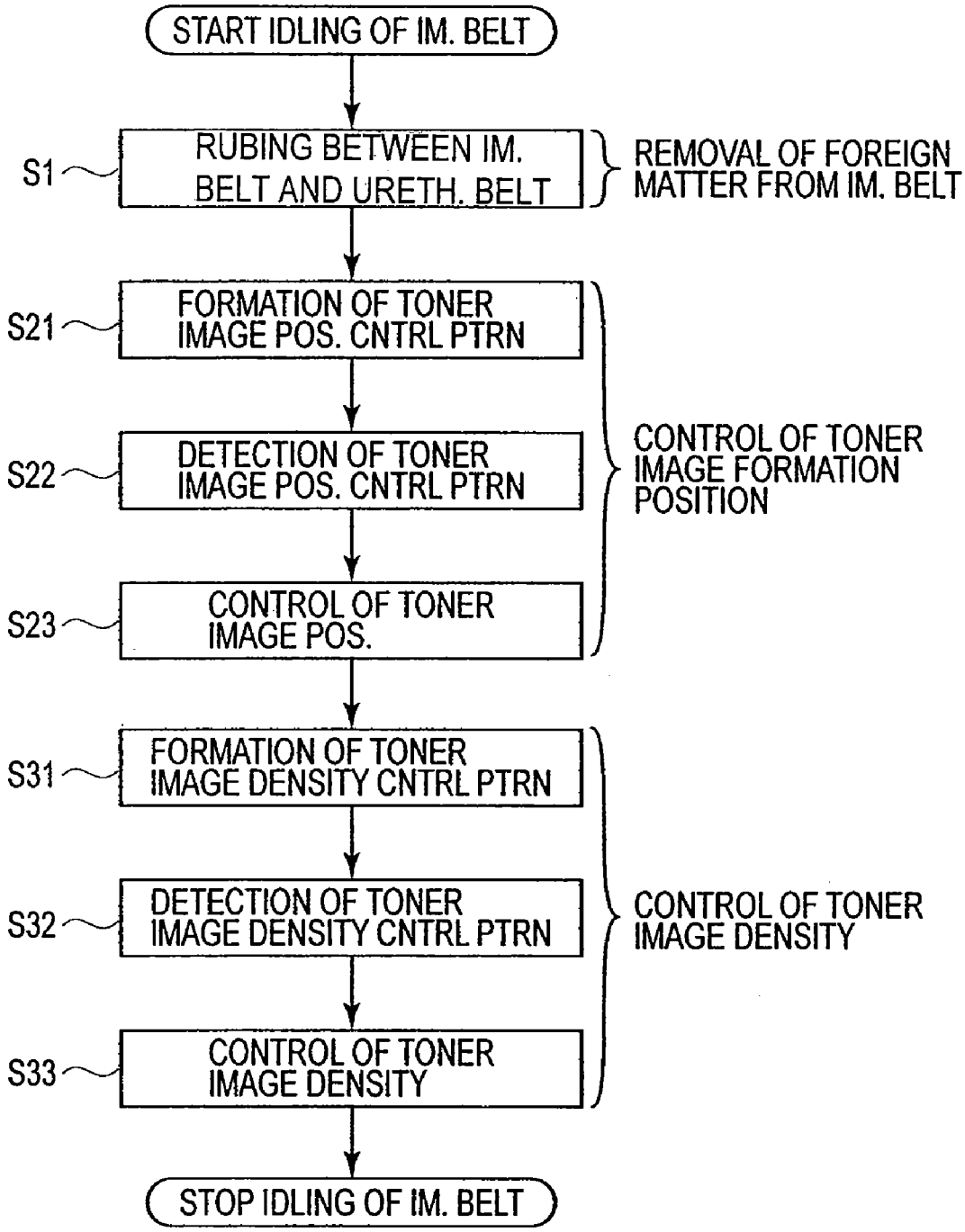
FIG. 14*b* is a flowchart of another recovery mode sequence.

Incidentally, in the case of the above described method shown in FIG. 14*a*, the image forming apparatus is corrected in the toner image formation position and toner image density, after the completion of the recovery mode. The step (S23) for correcting the image forming apparatus in terms of the toner image formation position may be carried out immediately after the step (S22) in which the toner image formation position control pattern is detected by the combination of the light emitting element 1028 and photosensitive element 1029, as shown in FIG. 14*b*. Further, the step (S32) in which the image forming apparatus is corrected in toner image density may be carried out immediately after the step (S32) in which the toner image density control pattern 1027*a* is detected by the combination of the light emitting element 1028 and photosensitive element 1029, as shown in FIG. 14*b*.

Figure 16:
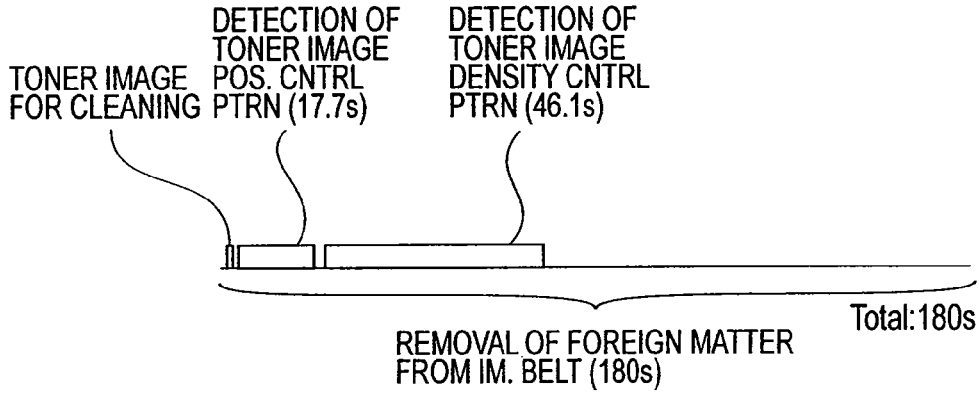
FIG. 16 is a drawing showing the recovery mode sequence.
Figure 17:
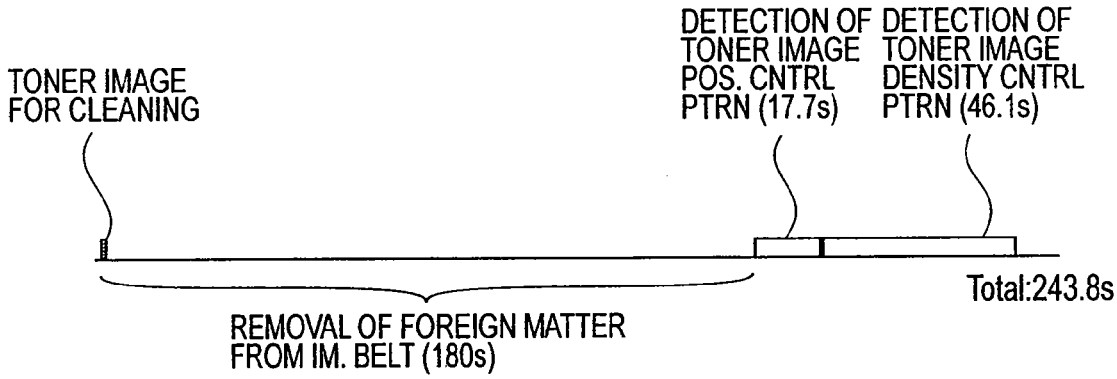
FIG. 17 is a drawing showing another recovery mode sequence.

Next, referring to FIG. 16, the total length of time used, in this embodiment, for detecting the images of the toner image position control pattern 1027*b* and toner image density control pattern 1027*a* is 63.8 seconds, being shorter than the length of time necessary for satisfactorily removing the residues on the intermediary transfer belt 8, which is 180 seconds.

In this embodiment, the toner image position control pattern 1027*b* and toner image density control pattern 1027*a* are detected during the removal of the adherent residue on the intermediary transfer belt 8. Therefore, the length of time the image forming apparatus in accordance with the present invention cannot be used for image formation is 180 seconds. In other words, it is roughly 55 seconds shorter than the length of the time for the recovery mode required by an image forming apparatus which does not carry out the process of detecting the toner image position control pattern 1027*b* and toner image density control pattern 1027*a* at the same time as it carries out the process of removing the adherent residue on the intermediary transfer belt 8. Thus, the employment of this embodiment also reduces the time necessary for the recovery mode.

Embodiment 2

In this embodiment, the image forming apparatus is provided with a door switch or the like which makes it possible to detect whether or not the door is open. Further, the image forming apparatus is designed so that as the door with a door switch is opened by an operator who inferred that the formation of a defective image was attributable to the presence of residues on the intermediary transfer belt, the recovery mode in the first embodiment is automatically carried out.

Embodiment 3

Figure 18:
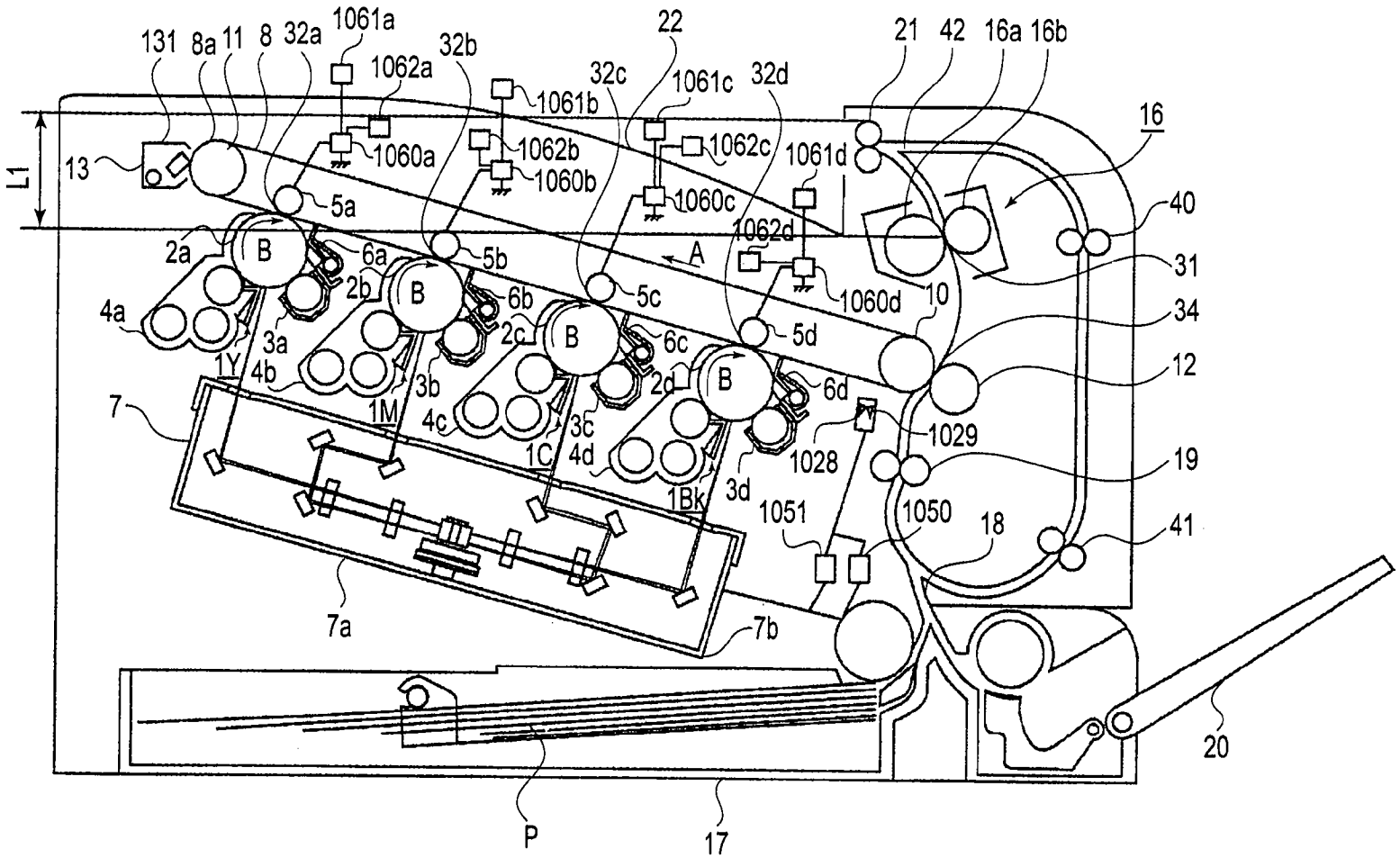
FIG. 18 is a drawing of the image forming apparatus in the third embodiment of the present invention, showing the general structure thereof.

FIG. 18 shows the image forming apparatus in this embodiment. The components of this image forming apparatus, which are similar in structure and function, are given the same referential symbols as those given to their counterparts of the image forming apparatus in the first embodiment, and will not be described.

Referring to FIG. 18, referential symbols 1061*a*, 1061*b*, 1061*c*, and 1061*d* designate transfer voltage detecting means for detecting the voltages which generate as biases which are proportional in amplitude to preset amount of electric current are applied to transfer rollers 5*a*, 5*b*, 5*c*, and 5*d* by transfer power sources 1060*a*, 1060*b*, 1060*c*, and 1060*d*, respectively. Designated by referential symbols 1062*a*, 1062*b*, 1062*c*, and 1062*d* are transfer voltage controlling means for controlling the voltages of the biases applied to the transfer rollers 5*a*, 5*b*, 5*c*, and 5*d*, according to the results of the detection by the transfer voltage detecting means 1061*a*, 1061*b*, 1061*c*, and 1061*d*, when transferring toner images from the image bearing members 2*a*, 2*b*, 2*c*, and 2*d*, respectively.

Figure 19:
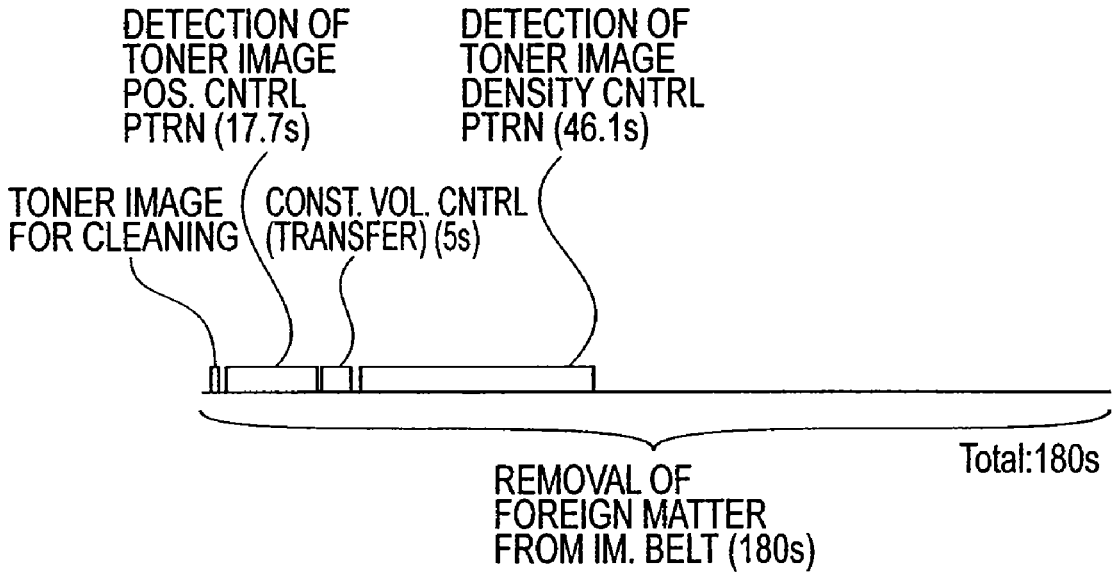
FIG. 19 is a drawing showing the recovery mode sequence in the second embodiment of the present invention.

In this embodiment, the recovery mode in the first embodiment is provided with an additional step which is carried out by the transfer voltage controlling means 1062*a*, 1062*b*, 1062*c*, and 1062*d*, at least before the detection of the image of the toner image density control pattern 1027*a*, in order to control in voltage the biases applied to the transfer rollers 5*a*, 5*b*, 5*c*, and 5*d*, respectively. FIG. 19 shows the recovery mode sequence in this embodiment.

Embodiment 4

Figure 20:
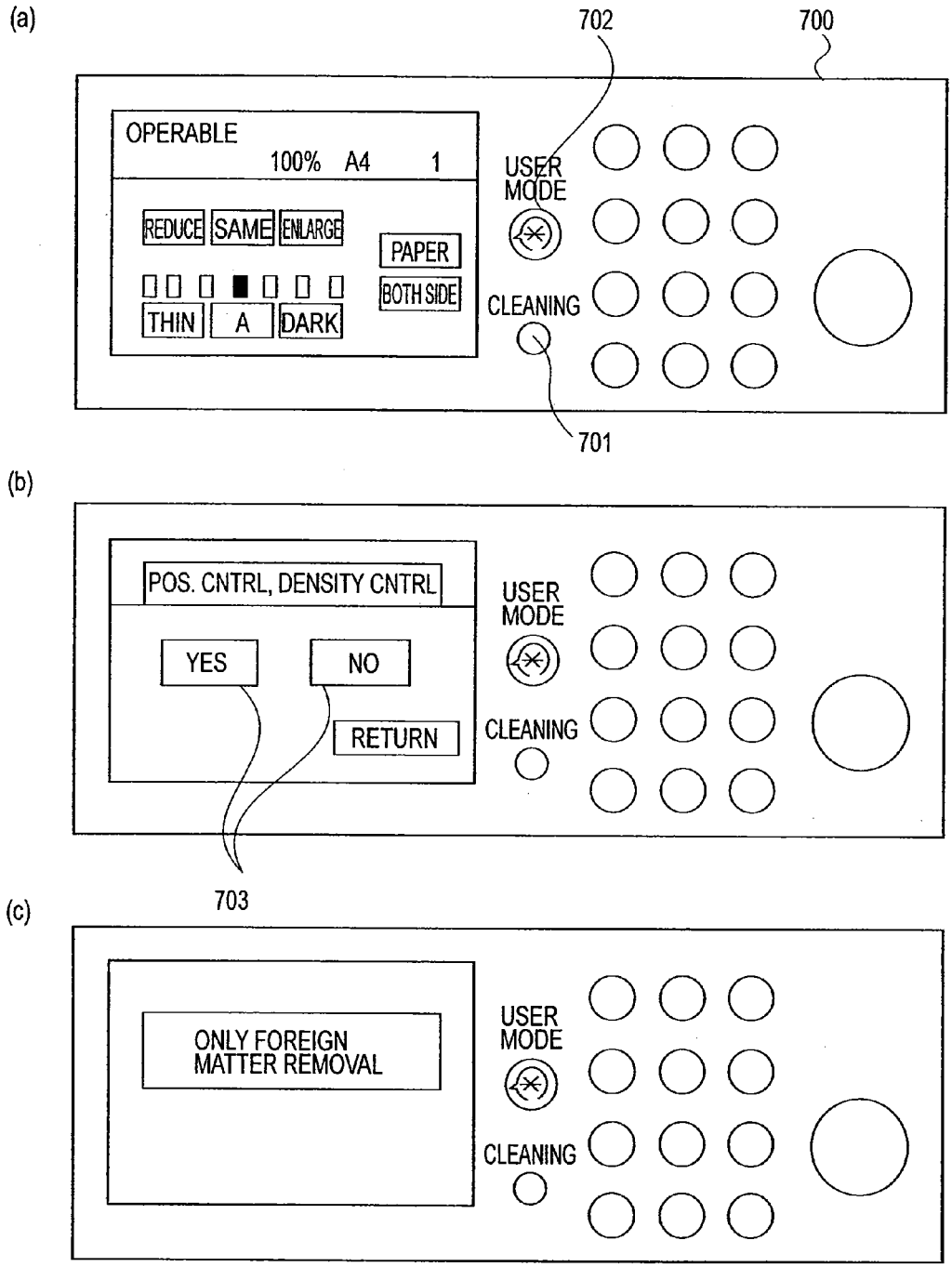
FIGS. 20*a*, 20*b*, and 20*c* are drawings showing the examples of the windows shown across the display portion of the control panel of the image forming apparatus in the fourth embodiment of the present invention.

In this embodiment, the image forming apparatus is provided with such a control portion as the one shown in FIG. 20(*a*). As a user depresses the intermediary transfer belt residue removal starting means 701 of the control panel 700 of the image forming apparatus, the same process as the one carried out by the image forming apparatus in the first embodiment is carried out to remove the residues having adhered to the intermediary transfer belt 8. Then, the user is to depress the mode setting button 702 of the control panel 700 to switch the display to the mode setting window, which enables the user to choose to, or not to choose to, carry out the process of controlling the toner formation position, and/or the process of controlling the toner image formation conditions.

Figure 21A:
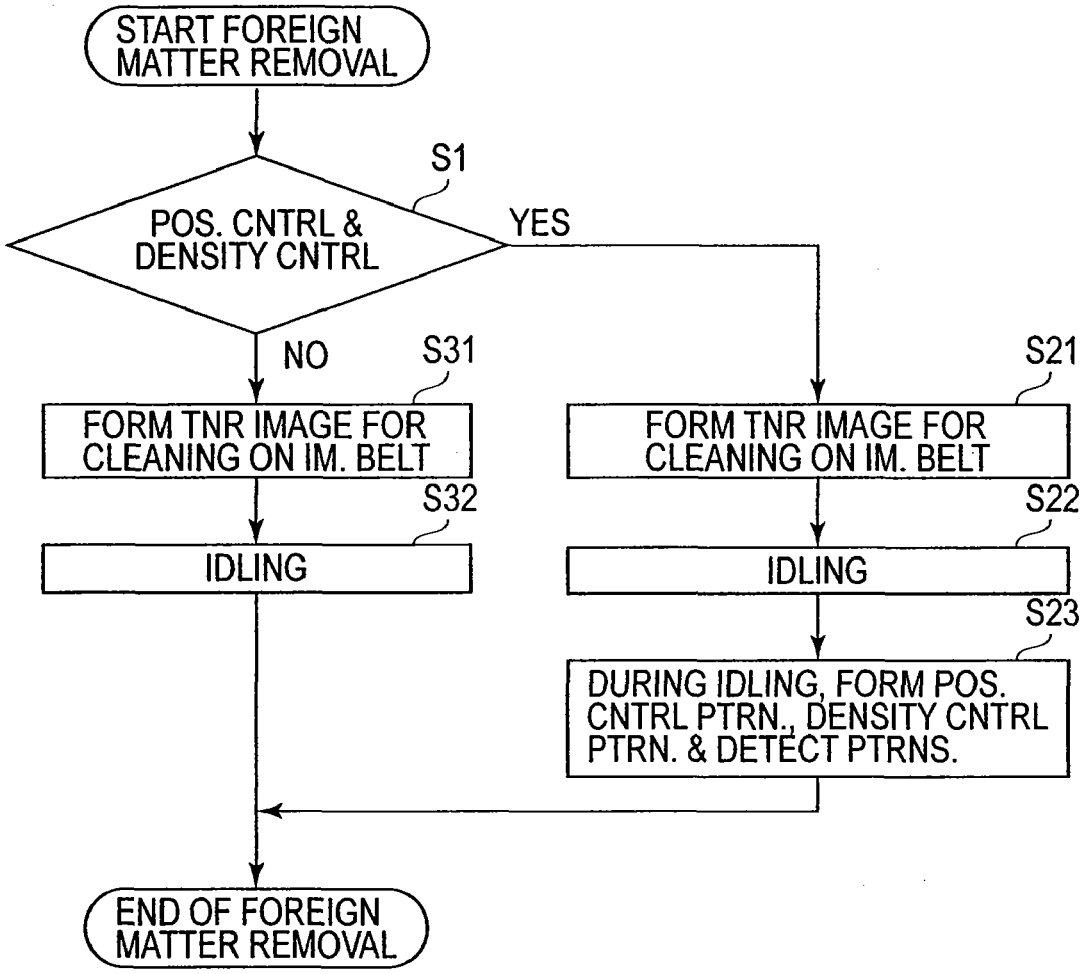
FIG. 21*a* is a flowchart of the recovery mode sequence in the fourth embodiment of the present invention, in which a selecting means can be used to clean the intermediary transferring member without carrying out the process of controlling the image forming apparatus in toner image position and toner image density.

FIG. 21*a* is a flowchart of the recovery mode sequence in the fourth embodiment of the present invention, in which a selecting means can be used to clean the intermediary transferring member without carrying out the process of controlling the image forming apparatus in toner image position and toner image density.

This sequence will be described with reference to FIG. 21*a*.

FIG. 20*b* shows the window 703 for instructing the image forming apparatus to carry out, or not to carry out, the image correction processes. A user can use this control selecting means 703 to choose, or not to choose, to cause the image forming apparatus to carry out the process of controlling the image forming apparatus in toner image formation position and toner image formation conditions at the same time as the process of removing the residues having adhered to the intermediary transfer belt 8 (Step S1 in FIG. 21*a*).

If the user chooses not to carry out the process of controlling the image forming apparatus in toner image formation position and toner image density at the same time as the residue removal, and depresses the residue removal starting means 701 to carry out the process of removing the residue, the display switches to the window shown in FIG. 20*c*, informing thereby the user that the image forming apparatus is going to carry out only the residue removal operation, and then, the residue removal operation begins (Steps S31 and S32 in FIG. 21*a*).

If the user chooses to carry out the process of controlling the toner image formation position and process of controlling the toner image density at the same time as the residue removal, and depresses the residue removal starting means 701 to cause the image forming apparatus to carry out the process of removing the residue, the toner image position control pattern 1027*b* and toner image density control pattern 1027*a* are formed immediately after the removal of the residues (Steps S21 and S22 in FIG. 21*a*). Then, the toner image position control pattern 1027*b* and toner image density control pattern 1027*a* are detected (Step S23 in FIG. 21*a*).

Then, the process of controlling the image forming apparatus in toner image formation position and toner image density are carried out during the period between the completion of the recovery mode, that is, the completion of the residue removal, and the starting of the formation of the next image.

Figure 21B:
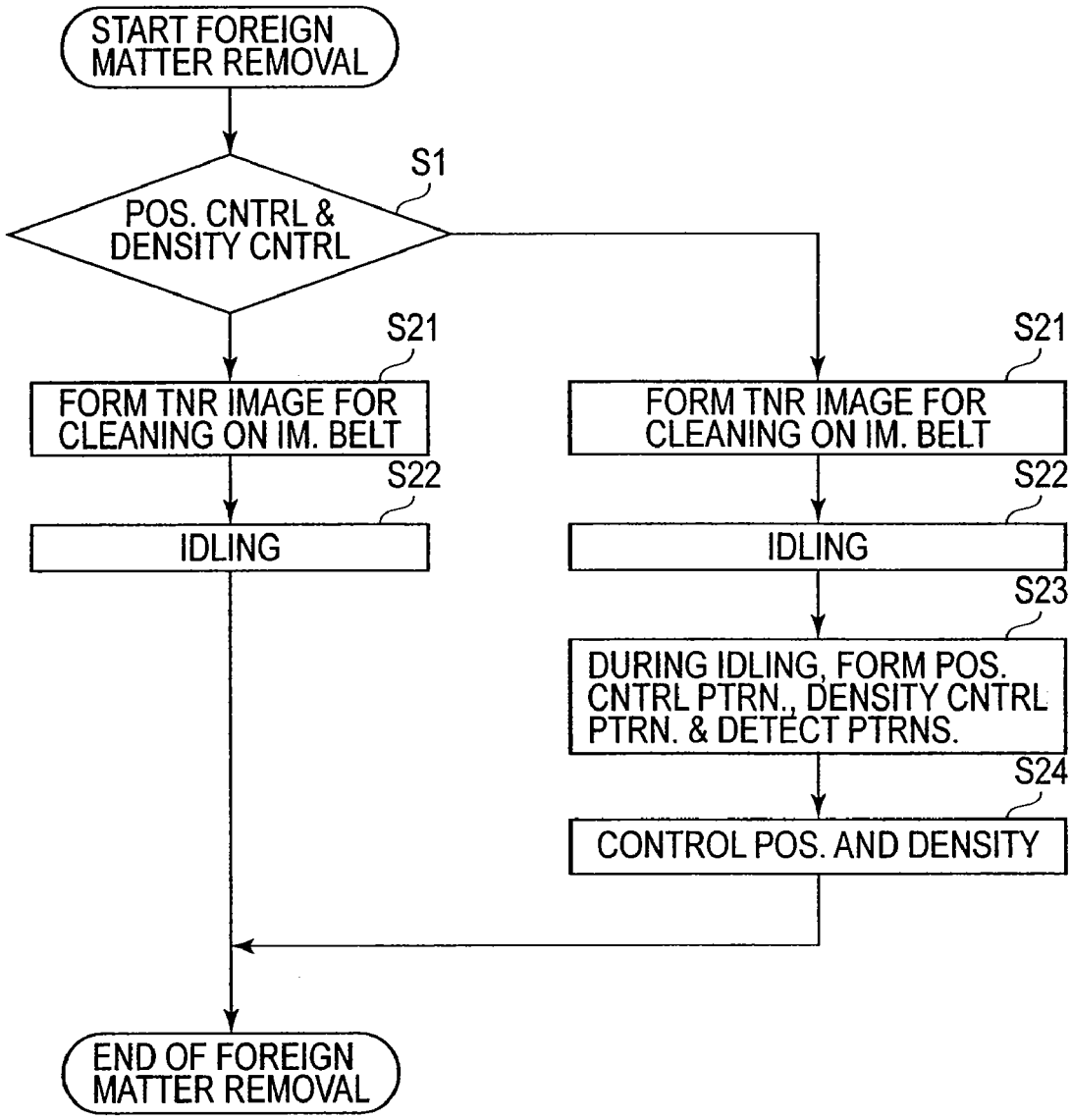
FIG. 21*b* is a flowchart of another recovery mode sequence in the forth embodiment of the present invention, in which a selecting means can be used to clean the intermediary transferring member without carrying out the process of controlling the image forming apparatus in toner image position and toner image density.

Incidentally, an image forming apparatus may be designed so that its CPU instructs the apparatus to begin to carry out the process of controlling the image forming apparatus in toner image formation position and toner image density after Step S23, and to complete the process before the completion of the residue removal process, as shown in FIG. 21*b* (Step S24 in FIG. 21*b*).

Embodiment 5

Figure 22:
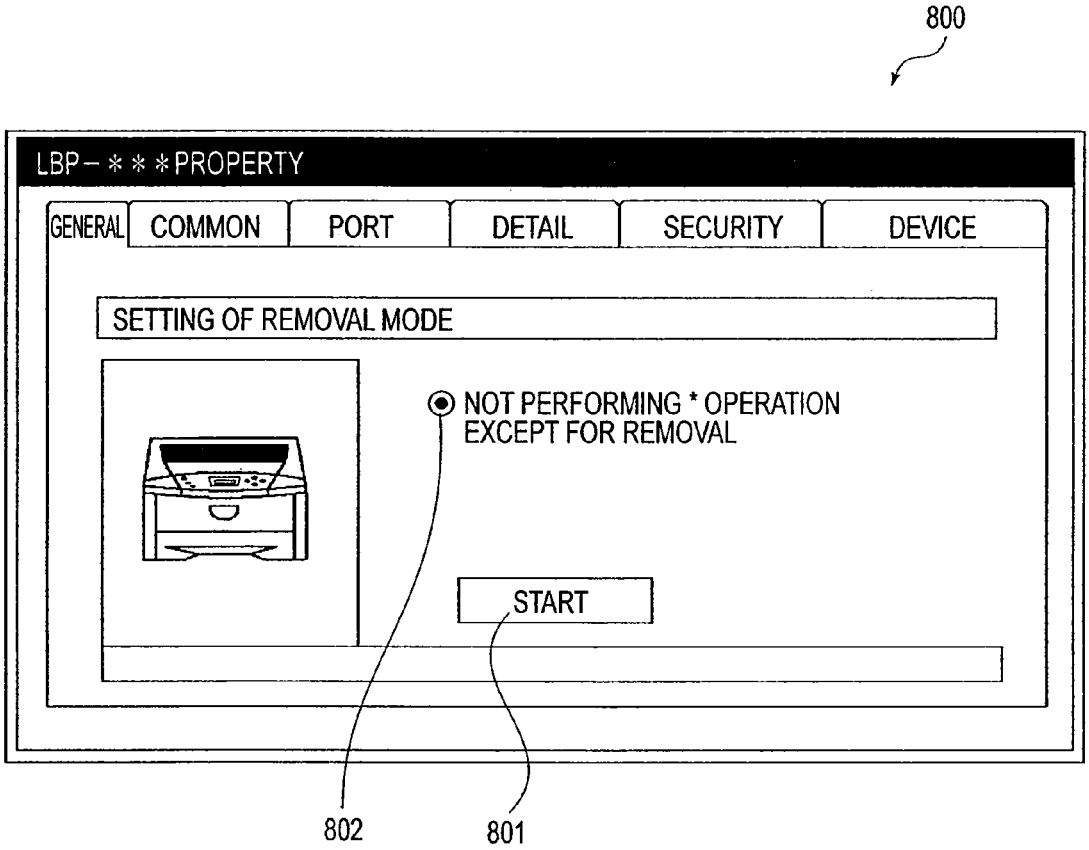
FIG. 22 is a drawing of the recovery mode window of the display portion in the fifth embodiment of the present invention.

FIG. 22 shows a residue removal mode starting means (window) 800, which is different from the one in the preceding embodiments. In the case of this residue removal mode starting means 800, through which a user can instruct an image forming apparatus to carry out the process of clearing the intermediary transfer belt 8 of the residues thereon, is a part of a computer or a workstation. As a user depresses (touches) the residue removal starting means 801 of the control portion 800, the above described process of clearing the intermediary transfer belt 8 of the residues thereon, and the process of controlling the image forming apparatus in toner image formation position and toner image formation conditions, begin. Also in the case of this embodiment, a user is allowed to choose, or not to choose, to cause the image forming apparatus to carry out the process of controlling the image forming apparatus in toner image formation position and toner image formation conditions at the same time as the process of removing the residues having adhered to the intermediary transfer belt 8.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 329235/2004 filed Nov. 12, 2004 which is hereby incorporated by reference.

What is claimed is:

1. An image forming apparatus comprising:

a rotatable image bearing member for bearing a toner image;

toner image forming means for forming a toner image on said image bearing member;

transferring means for transferring the toner image formed on said image bearing member onto a recording material;

a cleaning member contacted to said image bearing member to remove toner from said image bearing member after image transfer;

a detecting member for detecting a detection toner image formed on said image bearing member;

an adjusting portion for adjusting a toner image forming condition of said toner image forming means in accordance with a result of detection by said detecting member;

an executing portion for executing an operation in a recovery mode in a state in which said cleaning member is in contact with said image bearing member, wherein in the recovery mode, said executing means (i) starts rotation of said image bearing member, (ii) then causes said toner image forming means to form a band of toner having a width of a maximum image area measured in a direction perpendicular to a moving direction of said image bearing member, (iii) then causes said toner image forming means to form the detection toner image, and (iv) then causes said detecting member to detect the detection toner image for adjusting the image forming condition; and an input portion for causing said executing portion to execute the operation in the recovery mode.

2. An apparatus according to claim 1, further comprising an operating portion provided with said input portion.

3. An apparatus according to claim 1, wherein said adjusting portion adjusts the toner image forming condition on the basis of detection of the detection toner image formed during the execution of the operation in the recovery mode.

4. An apparatus according to claim 1, wherein said adjusting portion adjusts the toner image forming condition on the basis of detection of a position of the detection toner image formed during the execution of the operation in the recovery mode.

5. An apparatus according to claim 1, further comprising a selector for selecting formation of the detection toner image during the execution of the operation in the recovery mode.

* * * * *